US010252312B2

(12) United States Patent
Kubo et al.

(10) Patent No.: US 10,252,312 B2
(45) Date of Patent: Apr. 9, 2019

(54) PRESSED COMPONENT MANUFACTURING METHOD, PRESSED COMPONENT, MOLD, AND PRESS APPARATUS

(71) Applicant: NIPPON STEEL & SUMITOMO METAL CORPORATION, Tokyo (JP)

(72) Inventors: Masahiro Kubo, Tokyo (JP); Hiroshi Yoshida, Tokyo (JP); Takashi Miyagi, Tokyo (JP); Toshiya Suzuki, Tokyo (JP); Yoshiaki Nakazawa, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 15/567,652

(22) PCT Filed: Apr. 21, 2016

(86) PCT No.: PCT/JP2016/062681
§ 371 (c)(1),
(2) Date: Oct. 19, 2017

(87) PCT Pub. No.: WO2016/171228
PCT Pub. Date: Oct. 27, 2016

(65) Prior Publication Data

US 2018/0093315 A1 Apr. 5, 2018

(30) Foreign Application Priority Data

Apr. 22, 2015 (JP) ..... 2015-087502
Apr. 22, 2015 (JP) ..... 2015-087503

(51) Int. Cl.
*B21D 22/26* (2006.01)
*B21D 5/01* (2006.01)

(52) U.S. Cl.
CPC ..... *B21D 22/26* (2013.01); *B21D 5/01* (2013.01)

(58) Field of Classification Search
CPC ..... B21D 22/26; B21D 5/01
See application file for complete search history.

(56) References Cited

U.S. PATENT DOCUMENTS

2008/0246308 A1 10/2008 Uchida et al.
2013/0213109 A1 8/2013 Ogasawara
(Continued)

FOREIGN PATENT DOCUMENTS

CN 101132938 A 2/2008
JP 2004-168141 A 6/2004
(Continued)

OTHER PUBLICATIONS

Korean Office Action and partial English translation for corresponding Application No. 10-2017-7030291, dated Dec. 4, 2017.
(Continued)

*Primary Examiner* — Teresa M Ekiert
(74) *Attorney, Agent, or Firm* — Birch, Stewart, Kolasch & Birch, LLP

(57) ABSTRACT

A manufacturing method for a pressed component of the present disclosure is a manufacturing method for a pressed component configured including an elongated top plate, ridge line portions at both short direction ends of the top plate, and vertical walls that face each other in a state extending from the ridge line portions. A punch and a die are employed to curve a blank into a convex profile bowing from the punch side toward the die side in a state in which the punch is caused to contact a first portion of the blank where the two end ridge line portions are to be formed, and to sandwich a second portion of the blank where the top plate is to be formed between the die and the punch and indent the second portion from the die side toward the punch side.

4 Claims, 39 Drawing Sheets

(56) References Cited

U.S. PATENT DOCUMENTS

| | | | |
|---|---|---|---|
| 2013/0260103 | A1 | 10/2013 | Hashimoto et al. |
| 2014/0356643 | A1 | 12/2014 | Nakata et al. |
| 2015/0298197 | A1 | 10/2015 | Yoshida |
| 2015/0367397 | A1 | 12/2015 | Uchiyama et al. |

FOREIGN PATENT DOCUMENTS

| | | | |
|---|---|---|---|
| JP | 2004-314123 | A | 11/2004 |
| JP | 2006-240441 | A | 9/2006 |
| JP | 3864899 | B2 | 1/2007 |
| JP | 2013-027894 | A | 2/2013 |
| JP | 2013-169578 | A | 9/2013 |
| JP | 2013-202665 | A | 10/2013 |
| JP | 5382281 | B1 | 1/2014 |
| KR | 10-2015-0018638 | A | 2/2015 |
| WO | WO 2013/094705 | A1 | 6/2013 |
| WO | WO 2014/112056 | A1 | 7/2014 |

OTHER PUBLICATIONS

Explanation of Circumstances Related to Accelerated Examination issued in PCT/JP2016/062681, dated Sep. 7, 2016.

International Search Report (PCT/ISA/210) issued in PCT/JP2016/062681, dated Aug. 2, 2016.

Office Action issued in Japanese Patent Application No. 2016-556053, dated Jan. 17, 2017.

Office Action issued in Taiwanese Patent Application No. 105112645, dated Mar. 28, 2017.

Written Opinion (PCT/ISA/237) issued in PCT/JP2016/062681, dated Aug. 2, 2016.

International Preliminary Report on Patentability and English translation of Written Opinion of the International Searching Authority dated Oct. 24, 2017, issued in PCT/JP2016/062681 (Forms PCT/IB/373 and PCT/ISA/237).

FIG. 15

| STEEL TYPE | PLATE THICKNESS | STRENGTH | TOP PLATE PORTION PROFILE | EVALUATION OF CROSS-SECTION 1 TWISTING | EVALUATION OF CROSS-SECTION 2 TWISTING |
|---|---|---|---|---|---|
| | mm | MPa | mm | ° | ° |
| COMPARATIVE EXAMPLE 2 | 1.2 | 1310 | NONE | 19.52 | 17.34 |
| COMPARATIVE EXAMPLE 3 | 1.2 | 980 | NONE | 15.02 | 13.34 |
| COMPARATIVE EXAMPLE 4 | 1.2 | 590 | NONE | 6.01 | 5.34 |
| COMPARATIVE EXAMPLE 5 | 1.0 | 1310 | NONE | 23.42 | 20.81 |
| COMPARATIVE EXAMPLE 6 | 1.2 | 1470 | NONE | 14.64 | 11.9 |
| EXAMPLE 2 | 1.2 | 1310 | R110 | 12.25 | −7.52 |
| EXAMPLE 3 | 1.2 | 980 | R140 | 9.42 | −5.78 |
| EXAMPLE 4 | 1.2 | 590 | R250 | 3.77 | −2.31 |
| EXAMPLE 5 | 1.0 | 1310 | R90 | 14.70 | −9.02 |
| EXAMPLE 6 | 1.2 | 1470 | R70 | 2.15 | 1.33 |
| EXAMPLE 7 | 1.2 | 1310 | R60 | 3.34 | 2.41 |
| EXAMPLE 8 | 1.2 | 590 | R100 | 0.28 | 0.4 |

FIG. 16

| STEEL TYPE | PLATE THICKNESS | STRENGTH | TOP PLATE PORTION PROFILE | EVALUATION OF CROSS-SECTION 1 TWISTING | EVALUATION OF CROSS-SECTION 2 TWISTING |
|---|---|---|---|---|---|
| | mm | MPa | mm | ° | ° |
| COMPARATIVE EXAMPLE 7 | 1.2 | 1310 | NONE | 15.78 | 10.45 |
| COMPARATIVE EXAMPLE 8 | 1.2 | 980 | NONE | 16.31 | 6.06 |
| COMPARATIVE EXAMPLE 9 | 1.2 | 590 | NONE | 2.74 | 0.64 |
| COMPARATIVE EXAMPLE 10 | 1.0 | 1310 | NONE | 14.13 | 9.09 |
| COMPARATIVE EXAMPLE 11 | 1.2 | 1470 | NONE | 17.84 | 11.42 |
| EXAMPLE 9 | 1.2 | 1310 | R100 | 3.56 | 2.97 |
| EXAMPLE 10 | 1.2 | 980 | R100 | 1.74 | 0.52 |
| EXAMPLE 11 | 1.2 | 590 | R400 | 0.43 | 0.43 |
| EXAMPLE 12 | 1.0 | 1310 | R90 | 3.36 | 2.42 |
| EXAMPLE 13 | 1.2 | 1470 | R70 | 0.98 | 0.81 |
| EXAMPLE 14 | 1.2 | 1310 | R150 | 3.69 | 6.66 |

PRESSED COMPONENT MANUFACTURING METHOD, PRESSED COMPONENT, MOLD, AND PRESS APPARATUS

TECHNICAL FIELD

The present disclosure relates to a manufacturing method for a pressed component, a pressed component, a mold, and a press apparatus.

BACKGROUND ART

Automotive bodies are assembled by superimposing edges of multiple formed panels, joining the formed panels together by spot welding to configure a box body, and joining structural members to required locations on the box body by spot welding. Examples of structural members employed at a side section of an automotive body (body side) include side sills joined to both sides of a floor panel, an A-pillar lower and an A-pillar upper provided standing upward from a front portion of the side sill, a roof rail joined to an upper end portion of the A-pillar upper, and a B-pillar joining the side sill and the roof rail together.

Generally speaking, configuration elements (such as respective outer panels) of structural members including A-pillar lowers, A-pillar uppers, and roof rails often have a substantially hat-shaped lateral cross-section profile configured by a top plate extending in a length direction, two convex ridge line portions respectively connected to both sides of the top plate, two vertical walls respectively connected to the two convex ridge line portions, two concave ridge line portions respectively connected to the two vertical walls, and two flanges respectively connected to the two concave ridge line portions.

SUMMARY OF INVENTION

Technical Problem

The configuration elements described above have comparatively complex lateral cross-section profiles and are elongated. In order to suppress an increase in manufacturing costs, the above configuration elements are generally manufactured by cold pressing. Moreover, in order to both increase strength and achieve a reduction in vehicle body weight in the interests of improving fuel consumption, thickness reduction of the above structural members is being promoted through the use of, for example, high tensile sheet steel having a tensile strength of 440 MPa or greater.

However, when a high tensile sheet steel blank is cold pressed in an attempt to manufacture configuration elements that curve along their length direction, such as roof rail outer panels (referred to below as "roof members"; roof members are automotive structural members), spring-back occurs during removal from the press mold, leading to concerns of twisting in the top plate. There are therefore issues with shape fixability, whereby roof members cannot be formed in a desired shape.

For example, Japanese Patent Application Laid-Open (JP-A) No. 2004-314123 (referred to below as "Patent Document 1") describes an invention in which a pressed component having a uniform hat-shaped lateral cross-section along its length direction is applied with a step during manufacture in order to suppress opening-out, and thus improve the shape fixability.

Moreover, the specification of Japanese Patent No. 5382281 (referred to below as "Patent Document 2") describes an invention in which, during the manufacture of a pressed component that includes a top plate, vertical walls, and flanges, and that curves along its length direction, flanges formed in a first process are bent back in a second process so as to reduce residual stress in the flanges, thereby improving the shape fixability.

According to the invention described in Patent Document 1, when manufacturing pressed components having a shape that curves along the length direction, such as in configuration elements of configuration members such as A-pillar lowers, A-pillar uppers, or roof rails, spring-back occurs in the top plate after removal from the mold, such that the desired shape cannot be formed.

According to the invention described in Patent Document 2, when manufacturing pressed components that curve along the length direction and height direction and that include a bent portion in the vicinity of the length direction center, residual stress arises in the flange, residual stress arises within the faces of the vertical walls and the top plate, and residual deviatoric stress arises within the faces of the vertical walls and the top plate. As a result, spring-back occurs in the top plate after removal of the press component manufactured according to the invention described in Patent Document 2 from the mold, such that the desired shape cannot be formed.

An object of the present disclosure is to provide a manufacturing method for a specific pressed component in which the vertical walls are suppressed from closing in due to spring-back. Note that in the present specification, a "specific pressed component" is a pressed component configured including an elongated top plate, ridge line portions at both short direction ends of the top plate, and vertical walls that face each other in a state extending from the ridge line portions.

Solution to Problem

A manufacturing method for a pressed component of a first aspect according to the present disclosure is a manufacturing method for a specific pressed component. The manufacturing method includes employing a die and a punch to bend a blank into a profile protruding from the punch side toward the die side in a state in which a punch is caused to contact a first portion of the blank where the two end ridge line portions are to be formed, and to sandwich a second portion of the blank where the top plate is to be formed between the die and the punch, and indent the second portion from the die side toward the punch side.

A manufacturing method for a pressed component of a second aspect according to the present disclosure is a manufacturing method for a specific pressed component, wherein a punch and a die are employed to bend a blank from the punch side toward the die side in a state in which the punch is caused to contact a first portion of the blank where the two end ridge line portions are to be formed, and to sandwich a second portion of the blank where the top plate is to be formed between the die and the punch and indenting the second portion from the die side toward the punch side such that the second portion has a radius of curvature R (mm) that satisfies Equation (1).

$$\frac{t \cdot E \cdot 1000}{2|\sigma_s - \sigma_m|} \times 0.5 \leq R \leq \frac{t \cdot E \cdot 1000}{2|\sigma_s - \sigma_m|} \times 4 \quad (1)$$

wherein each parameter in Equation (1) is as follows:

t is a plate thickness (mm) of the blank;

$\sigma_s$ is a short direction bend outer surface stress (MPa) of the blank to form the top plate in the short direction;

$\sigma_m$ is an average stress in cross section of short direction (MPa) of the portion of the blank to form the top plate; and E is a Young's Modulus (GPa) of sheet steel configuring the blank.

A manufacturing method for a pressed component of a third aspect according to the present disclosure is a manufacturing method for a specific pressed component, wherein a die and a punch are employed to bend a blank from the punch side toward the die side in a state in which the punch is caused to contact a first portion of the blank where the two end ridge line portions are to be formed, and to sandwich a second portion of the blank where the top plate is to be formed between the die and the punch and to indent the second portion from the die side toward the punch side such that the second portion has a radius of curvature R (mm) that satisfies Equation (2)

$$\frac{t \cdot E \cdot 1000}{2 \cdot \sigma_{TS}} \leq R \leq \frac{t \cdot E \cdot 1000}{\sigma_{YP}} \quad (2)$$

wherein each parameter in Equation (2) is as follows:

t is a plate thickness (mm) of the blank;

$\sigma_{TS}$ is a tensile strength (MPa) of the blank;

$\sigma_{YP}$ is a yield stress (MPa) of the blank; and

E is a Young's Modulus (GPa) of sheet steel configuring the blank.

A manufacturing method for a pressed component of a fourth aspect according to the present disclosure is the manufacturing method for a specific pressed component of the first to the third aspect, wherein an apex face of the punch is curved as viewed along a direction in which the punch and the die face each other, and a groove that is curved so as to follow the apex face of the punch is formed in the die, and a pressed component is manufactured in which the top plate is curved as viewed along a plate thickness direction of the top plate.

A manufacturing method for a pressed component of a fifth aspect according to the present disclosure is the manufacturing method for a specific pressed component of the first to the fourth aspect, wherein an apex face of the punch is curved in a convex profile bowing toward the die side as viewed along an orthogonal direction orthogonal to both a direction in which the punch and the die face each other and the length direction of the punch, and a groove that is curved so as to follow the apex face of the punch is formed in the die, and a pressed component is manufactured in which the top plate is curved as viewed along a short direction of the top plate.

A pressed component according to the present disclosure is a specific pressed component, in which the top plate includes a minimum portion where the Vickers hardness value is a minimum value between one end and another end in a short direction of the top plate, and maximum portions where the Vickers hardness value is a maximum value in each range out of a first range between the minimum portion and the one end, and a second range between the minimum portion and the other end.

A mold according to the present disclosure is a mold for manufacturing a pressed component configured including an elongated top plate, ridge line portions at both short direction ends of the top plate, and vertical walls that face each other in a state extending from the ridge line portions. The mold includes a punch and die. An apex face of the punch is a recessed face having a radius of curvature R (mm) of from 38 mm to 725 mm, and a blank is pressed between the punch and the die by sandwiching a portion of the blank where the top plate is to be formed between the die and the punch and indenting the portion of the blank from the die side toward the punch side.

A press apparatus according to the present disclosure includes the mold according to the present disclosure, as described above, and a moving section that moves the punch relative to the die.

Advantageous Effects of Invention

A specific pressed component in which closing in of the vertical walls due to spring-back is suppressed can be manufactured by employing the manufacturing method for a pressed component according to the present disclosure.

In the pressed component according to the present disclosure, the amount by which the vertical walls close in due to spring-back is small.

A specific pressed component in which closing in of the vertical walls due to spring-back is suppressed can be manufactured by employing the mold according to the present disclosure.

A specific pressed component in which closing in of the vertical walls due to spring-back is suppressed can be manufactured by employing the press device according to the present disclosure.

BRIEF DESCRIPTION OF DRAWINGS

FIG. 15 is a table illustrating evaluation results based on simulation regarding twisting in top plates of roof members of respective Examples (Examples 2 to 8) of the first exemplary embodiment, and twisting in top plates of roof members of respective Comparative Examples (Comparative Examples 2 to 6) of the second comparative embodiment.

FIG. 16 is a table illustrating evaluation results based on simulation regarding twisting in top plates of roof members of respective Examples (Examples 9 to 14) of the second exemplary embodiment, and twisting in top plates of roof members of respective Comparative Examples (Comparative Examples 7 to 11) of the second comparative embodiment.

DESCRIPTION OF EMBODIMENTS

Summary

Explanation follows regarding the three exemplary embodiments (a first, a second, and a third exemplary embodiment) as embodiments for implementing the present disclosure. This will be followed by explanation regarding Examples. Note that in the present specification, exemplary embodiments refer to embodiments for implementing the present disclosure.

First Exemplary Embodiment

Explanation follows regarding the first exemplary embodiment. First, explanation follows regarding configuration of a roof member (see FIG. 1A, FIG. 1B, FIG. 1C, and FIG. 1D) of the present exemplary embodiment. Next, explanation is given regarding configuration of a press apparatus 17 (see FIG. 2A, FIG. 2B, FIG. 3A, and FIG. 3B) of the present exemplary embodiment. This will be followed by explanation regarding a manufacturing method of the roof member of the present exemplary embodiment. This will then be followed by explanation regarding advantageous effects of the present exemplary embodiment.

Roof Member Configuration

First, explanation follows regarding configuration of the roof member 1 of the present exemplary embodiment, with reference to the drawings. Note that the roof member 1 is an example of a pressed component and a specific pressed component.

As illustrated in FIG. 1A, FIG. 1B, FIG. 1C, and FIG. 1D, the roof member 1 is an elongated member and has a substantially hat-shaped cross-section profile integrally configured including a top plate 2, two convex ridge line portions 3*a*, 3*b*, two vertical walls 4*a*, 4*b*, two concave ridge line portions 5*a*, 5*b*, and two flanges 6*a*, 6*b*. Note that the convex ridge line portions 3*a*, 3*b* are an example of ridge line portions. The roof member 1 is, for example, configured by a component cold pressed from a high tensile steel stock sheet having 1310 MPa grade tensile strength. Namely, the roof member 1 of the present exemplary embodiment is, for example, configured by a component cold pressed from a high tensile steel stock sheet having a tensile strength of from 440 MPa to 1600 MPa.

Figure 1A:
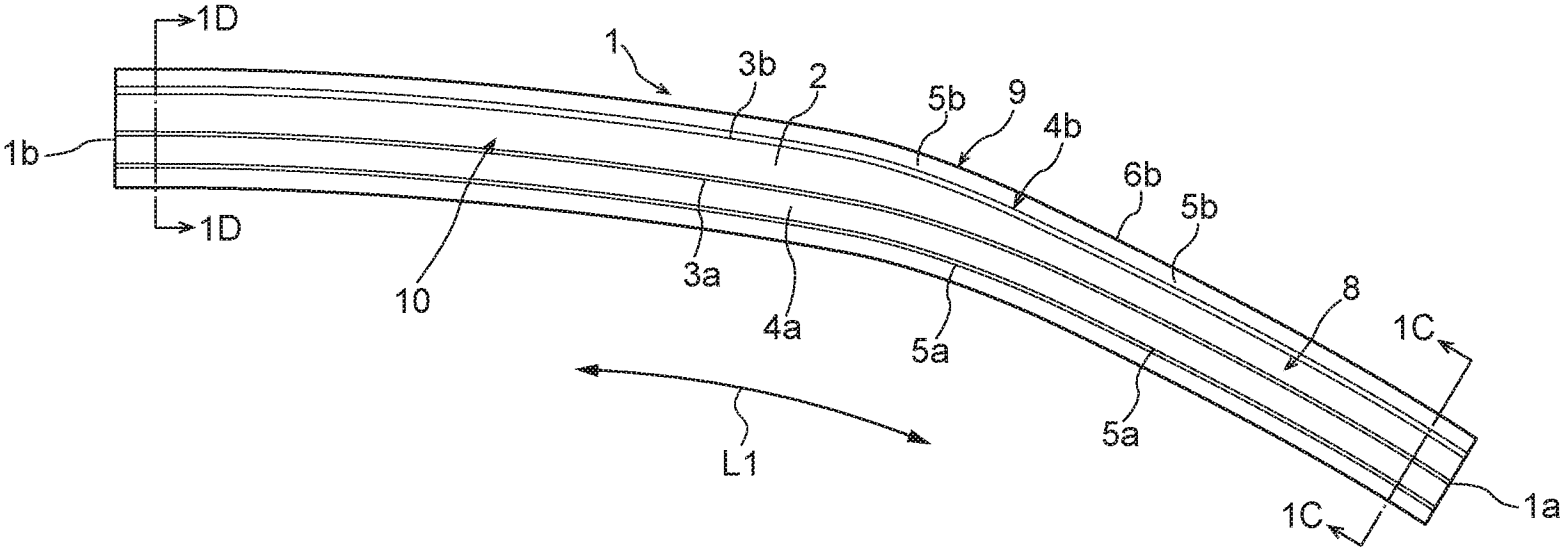
FIG. 1A is a top view illustrating a roof member (pressed component) of a first exemplary embodiment.
Figure 1B:
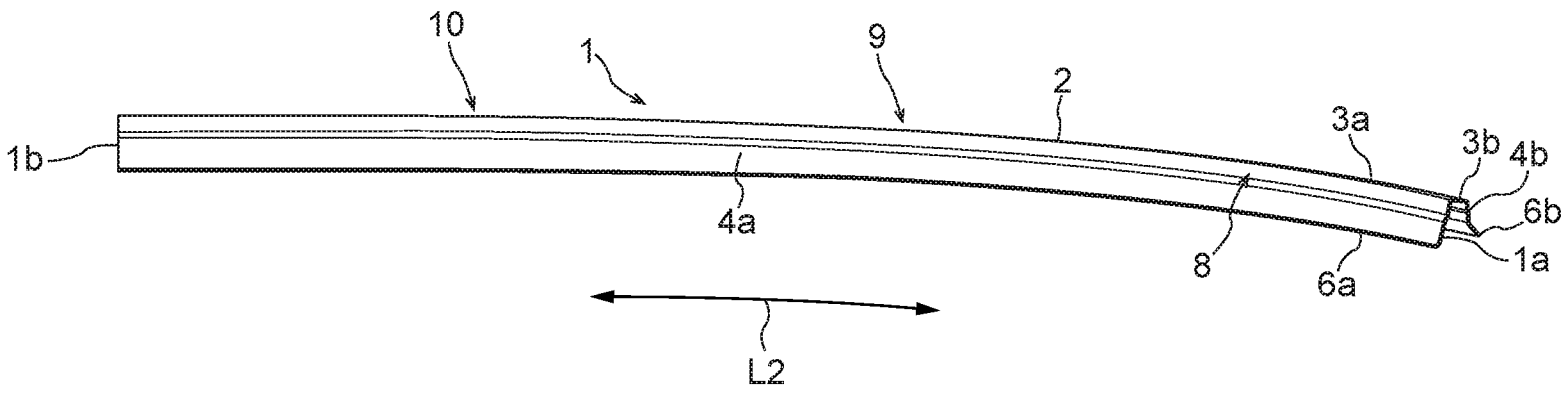
FIG. 1B is a side view illustrating a roof member of the first exemplary embodiment.

As illustrated in FIG. 1A and FIG. 1B, the top plate 2 is elongated. As illustrated in FIG. 1A, the top plate 2 is curved along its length direction when viewed from the upper side of the top plate 2, namely, curved along arrow L1 in the drawings. As illustrated in FIG. 1B, the top plate 2 is also curved along its length direction when viewed from the side of a side-face of the top plate 2, namely, curved along arrow L2 in the drawings. Namely, in side view, the roof member 1 is curved along its length direction such that the top plate 2 is curved in a convex profile bowing toward the top plate 2 side.

As illustrated in FIG. 1A and FIG. 1B, the two convex ridge line portions 3*a*, 3*b* are formed at both short direction ends of the top plate 2. The two vertical walls 4*a*, 4*b* face each other in a state extending from the respective convex ridge line portions 3*a*, 3*b*. Namely, the roof member 1 of the present exemplary embodiment is configured including the elongated top plate 2, the convex ridge line portions 3*a*, 3*b* at both short direction ends of the top plate 2, and the vertical walls 4*a*, 4*b* opposing each other in a state extending from the respective convex ridge line portions 3*a*, 3*b*.

Figure 1C:
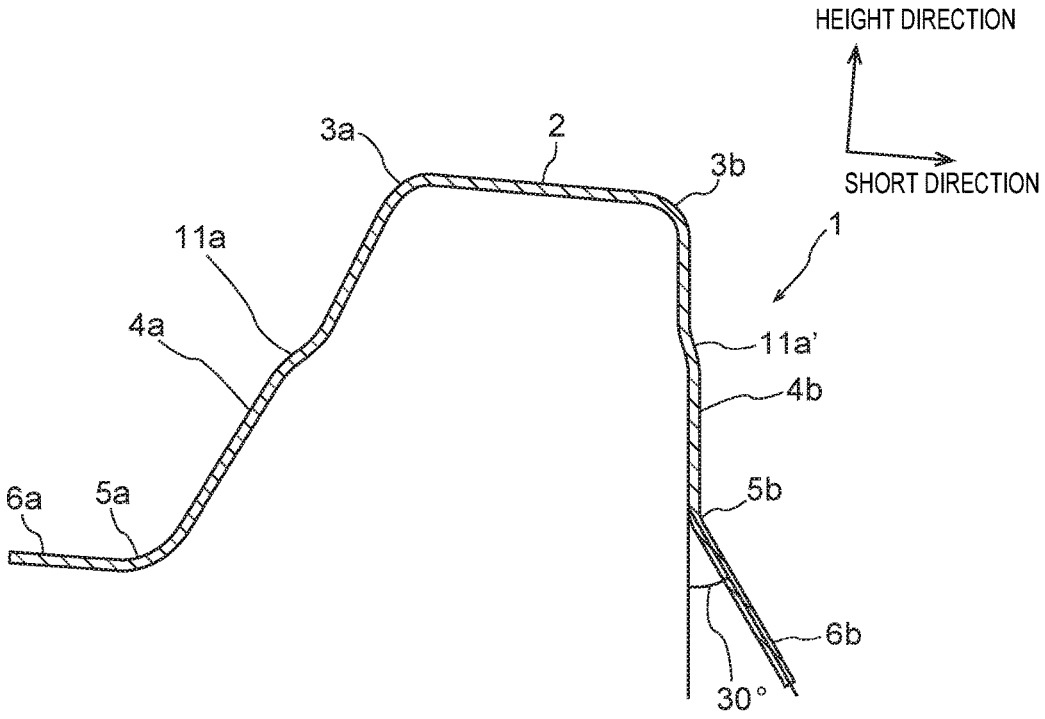
FIG. 1C is a cross-section taken along 1C-1C in FIG. 1A.
Figure 1D:
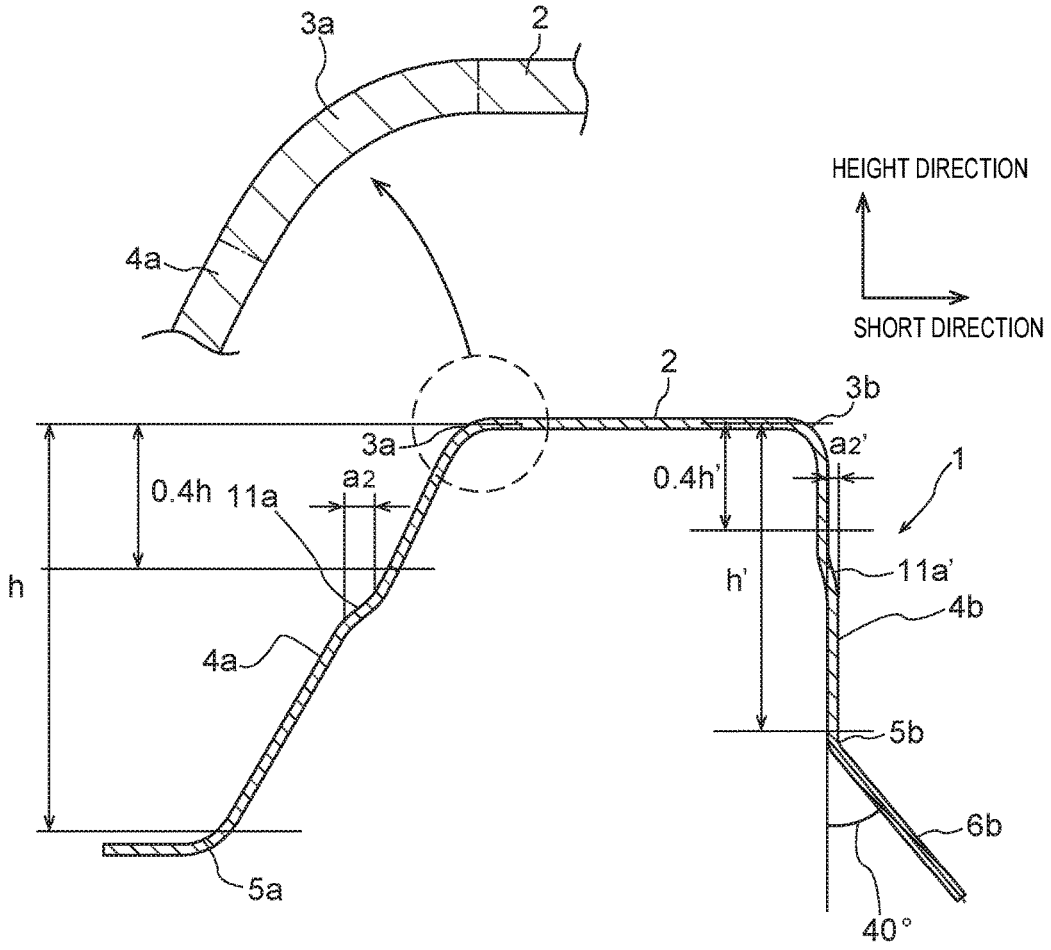
FIG. 1D is a cross-section taken along 1D-1D in FIG. 1A.
Figure 14:
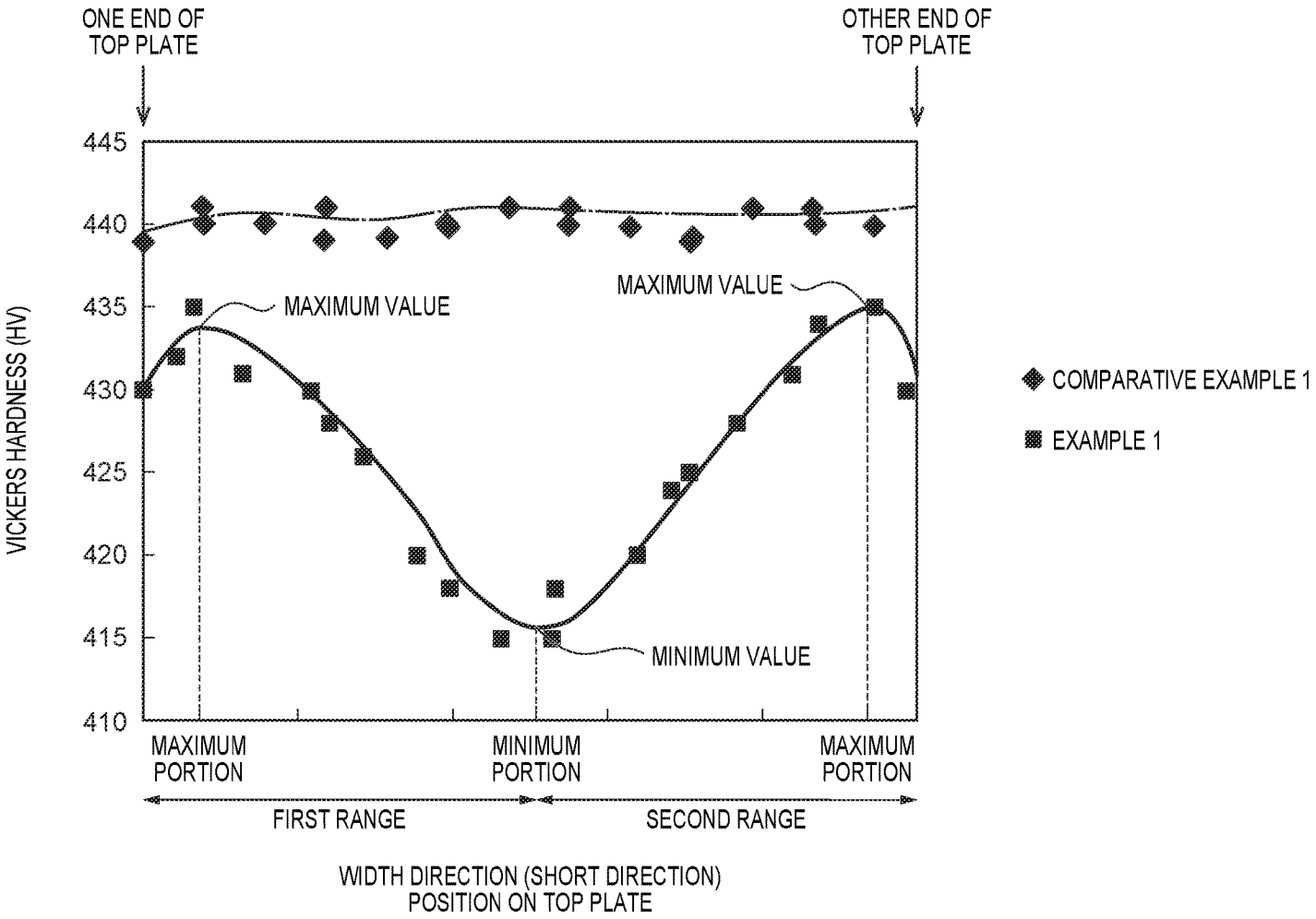
FIG. 14 is a graph illustrating results from measuring the Vickers hardness of a top plate as measured in a range spanning from one short direction end to another short direction end of a top plate of Example 1, and the Vickers hardness of a top plate as measured in a range spanning from one short direction end to another short direction end of a top plate of Comparative Example 1.

In the present exemplary embodiment, for example, respective cross-sections taken perpendicularly to the length direction of the top plate 2 extend in a straight-line shape along the short direction at each length direction position. Namely, when the top plate 2 of the present exemplary embodiment is viewed in respective perpendicular cross-sections along the length direction, as illustrated in FIG. 1C and FIG. 1D, the top plate 2 is flat at each length direction position. Note that as illustrated in FIG. 1D, the convex ridge line portion 3*a* is a portion that connects the top plate 2 and the vertical wall 4*a* together, and is a curved portion when viewed in respective cross-sections taken perpendicularly to the length direction of the top plate 2. The two single-dotted dashed lines in the drawings respectively indicate the two ends of the convex ridge line portion 3*a* connected to the top plate 2 and the vertical wall 4*a*. Illustration of both ends of the convex ridge line portion 3*b* by single-dotted dashed lines is omitted from the drawings; however, the convex ridge line portion 3*b* is a portion that connects the top plate 2 and the vertical wall 4*b* together, and is a curved portion when viewed in respective cross-sections taken perpendicularly to the length direction of the top plate 2. As illustrated in FIG. 14, the top plate 2 of the present exemplary embodiment includes a central portion at the short direction center of the top plate 2 where the Vickers hardness value of the top plate 2 is a minimum value, and maximum portions where the respective Vickers hardness value of the top plate 2 is a maximum value, namely, at a maximum value in each range out of a first range that is the range between the central portion and one short direction end of the top plate 2 and a second range that is the range between the center portion and another short direction end of the top plate 2. Note that in the present specification, the central portion at the short direction center of the top plate 2 where the Vickers hardness value is the minimum value is called the minimum portion.

The roof member 1 of the present exemplary embodiment is a member manufactured by pressing a blank BL, illustrated in FIG. 2B, using a manufacturing method of the roof member 1 of the present exemplary embodiment, described later. Note that the Vickers hardness of the blank BL is, for example, 430 HV. By contrast, the Vickers hardness of the minimum portion of the top plate 2 of the roof member 1 is, for example, approximately 417 HV, as illustrated in FIG. 14. Namely, the Vickers hardness of the central portion of the top plate 2 is less than the Vickers hardness of the blank BL prior to being pressed. Further, the Vickers hardness of an end portion of the flange 6*b* of the roof member 1 is, for example, 430 HV. Namely, the Vickers hardness of the central portion of the top plate 2 is less than the Vickers hardness of the end portion of the flange 6*b*. In other words, it may be said that in the roof member 1 of the present exemplary embodiment, the top plate 2 is softer than the end portion of the flange 6*b*. The end portion of the flange 6*b* refers to a portion of the flange 6*b* of the roof member 1 from an end on the opposite side to the side connected to the concave ridge line portion 5*b* to up to 5 mm toward the ridge line portion 5*b* side. Note that as explained above, the reason the end portion of the flange 6*b* is harder than the top plate 2 is thought to be because the flange 6*b* is not deformed as much as the top plate 2 in the manufacturing method of the roof member 1, described later.

Further, the two concave ridge line portions 5*a*, 5*b* are respectively formed at end portions of the two vertical walls 4*a*, 4*b* on the opposite side to the side connected to the top plate 2. The two flanges 6*a*, 6*b* are connected to the two respective concave ridge line portions 5*a*, 5*b*. Illustration of the concave ridge line portion 5*a* is omitted from the drawings; however, the concave ridge line portion 5*a* is a portion that connects the vertical wall 4*a* and the flange 6*a* together, and is a curved portion when viewed in respective cross-sections taken perpendicularly to the length direction of the top plate 2. Illustration of the two ends of the concave ridge line portion 5*b* by single-dotted dashed lines is omitted from the drawings; however, the concave ridge line portion 5*b* is a portion that connects the vertical wall 4*b* and the flange 6*b* together, and is a curved portion when viewed in respective cross-sections taken perpendicularly to the length direction of the top plate 2.

As illustrated in FIG. 1A, as viewed from the top plate 2 side in a state in which the top plate 2 is disposed so as to be orientated at a position on the upper side, the roof member 1 is curved from a front end portion 1*a*, namely one length direction end portion, to a rear end portion 1*b*, namely another length direction end portion. From another perspective, as illustrated in FIG. 1A and FIG. 1B, it may be said that the roof member 1 is integrally configured including a first section 8 including the front end portion 1*a*, a third section 10 including the rear end portion 1*b*, and a second section 9 connecting the first section 8 and the third section 10 together.

Note that in the present exemplary embodiment, in top view (as viewed from the upper side of the top plate 2) the radius of curvature R of the first section 8 is, for example, set to from 2000 mm to 9000 mm, the radius of curvature R of the second section 9 is, for example, set to from 500 mm to 2000 mm, and the radius of curvature R of the third section 10 is, for example, set to from 2500 mm to 9000 mm. Moreover, as illustrated in FIG. 1B, in the present exemplary embodiment, in side view (as viewed from a width direction side of the top plate 2) the radius of curvature R of the first section 8 is, for example, set to from 3000 mm to 15000 mm, the radius of curvature R of the second section 9 is, for example, set to from 1000 mm to 15000 mm, and the radius of curvature R of the third section 10 is, for example, set to from 3000 mm to 15000 mm. As described above, the radius of curvature R of the first section 8 and the radius of curvature R of the third section 10 are each larger than the radius of curvature R of the second section 9.

As illustrated in FIG. 1D, a height from a plate thickness center at the end of curvature at a curvature start point on the top plate 2 side of the convex ridge line portion 3*a*, namely, from a plate thickness center of the top plate 2, up to an end of the vertical wall 4*a* on the concave ridge line portion 5*a* side, is a height h. In this configuration, a step 11*a* having a step amount a2 (mm) is formed on the vertical wall 4*a*, so as to span the length direction of the vertical wall 4*a* at a portion thereof that is a distance of not less than 40% of the height h away from the plate thickness center of the top plate 2. Further, as illustrated in FIG. 1D, a height from a plate thickness center of the end of curvature at a curvature start point on the top plate 2 side of the convex ridge line portion 3*b*, namely, from a plate thickness center of the top plate 2, up to an end of the vertical wall 4*b* on the concave ridge line portion 5*b* side, is a height h'. In this configuration, a step 11*a*' having a step amount a2' (mm) is formed on the vertical wall 4*b*, so as to span the length direction of the vertical wall 4*b* at a portion thereof that is a distance of not less than 40% of the height h away from the plate thickness center of the top plate 2.

As illustrated in FIG. 1C and FIG. 1D, the cross-section profiles of the flanges 6*a*, 6*b* differ between the front end portion 1*a* and the rear end portion 1*b* in the length direction of the roof member 1. Specifically, the angle of the flange 6*b* with respect to the vertical wall 4*b* is 30° at the front end portion 1*a* and 40° at the rear end portion 1*b*. Further, the respective angles of the flanges 6*a*, 6*b* with respect to the vertical wall 4*a* change progressively along the length direction. Further, the width of the short direction of the top plate 2 changes along the length direction so as become progressively wider from the front end portion 1*a* to the rear end portion 1*b*. Note that as illustrated in FIG. 1A to FIG. 1D, the angle formed between the vertical wall 4*b* and the flange 6*b* at the first section 8 is preferably no less than the angle formed between the vertical wall 4*b* and the flange 6*b* at the third section 10.

The foregoing explanation relates to configuration of the roof member 1 of the present exemplary embodiment.

Press Apparatus Configuration

Next, explanation follows regarding the press apparatus 17 of the present exemplary embodiment, with reference to the drawings. The press apparatus 17 of the present exemplary embodiment is used to manufacture the roof member 1 of the present exemplary embodiment. As illustrated in FIG. 2A, FIG. 2B, FIG. 3A, and FIG. 3B, the press apparatus 17 is configured including a first press device 18 and a second press device 19. The press apparatus 17 of the present exemplary embodiment employs the first press device 18 to draw the blank BL illustrated in FIG. 2B so as to press the blank BL to form an intermediate formed component 30, illustrated in FIG. 3B, and then uses the second press device 19 to press the intermediate formed component 30 to manufacture a manufactured component, namely the roof member 1. Note that the blank BL is configured by elongated high tensile sheet steel as a base material for manufacturing the roof member 1.

Figure 3A:
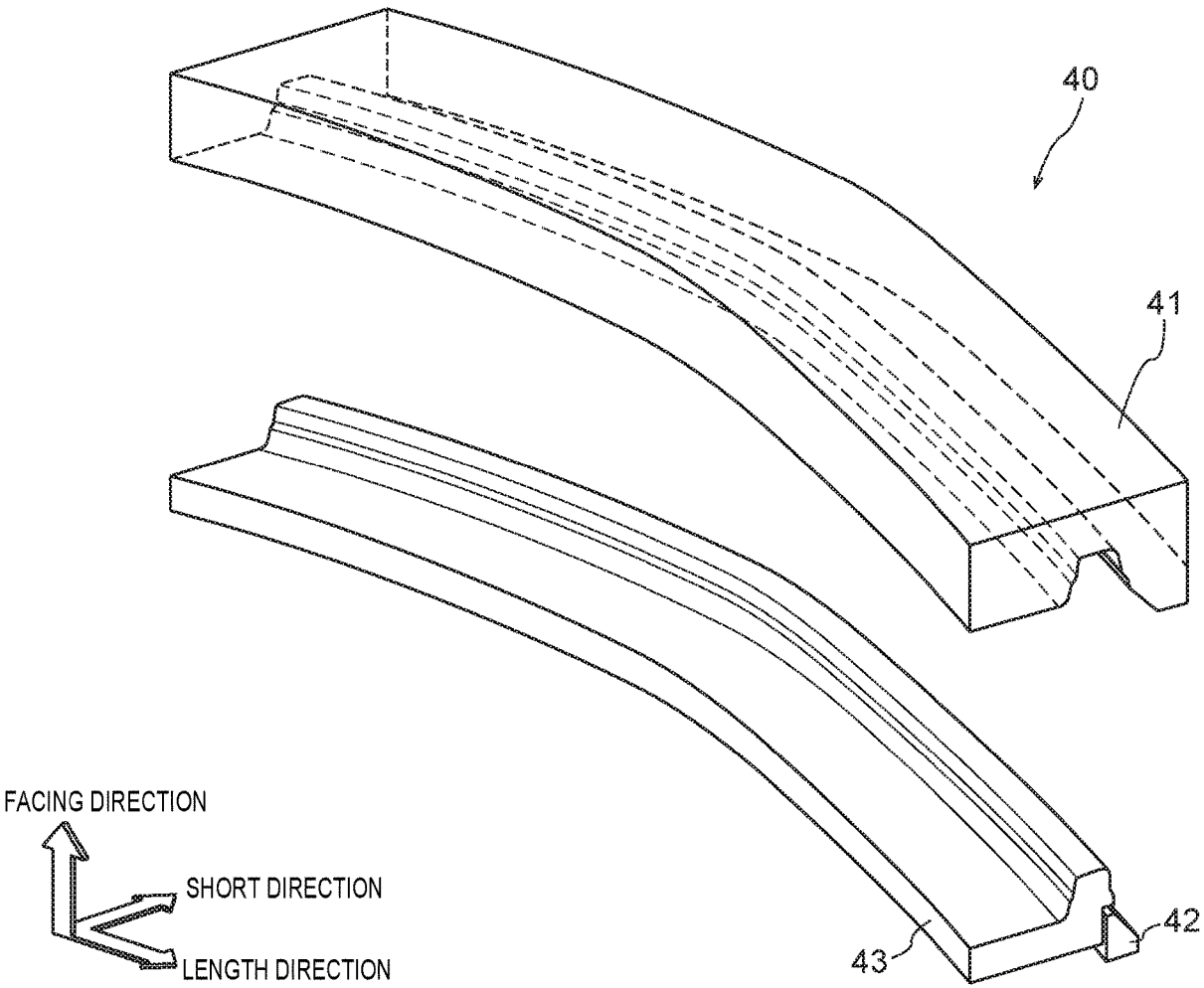
FIG. 3A is a perspective view of a mold of a second press device employed in a second pressing process of a manufacturing method of a roof member of the first exemplary embodiment.
Figure 3B:
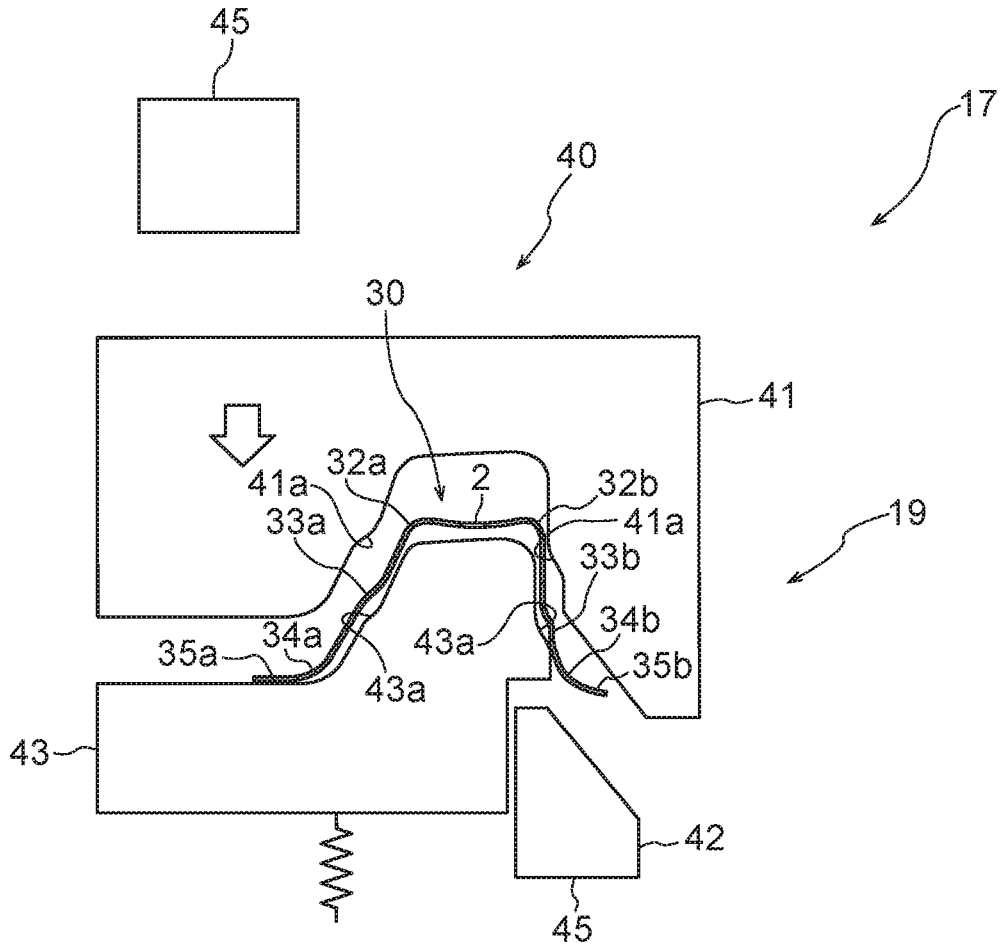
FIG. 3B is a vertical cross-section of a second press device employed in a second pressing process of a manufacturing method of a roof member of the first exemplary embodiment.

Note that as illustrated in FIG. 3B, the intermediate formed component 30 is a substantially hat-shaped member configured including the top plate 2, two convex ridge line portions 32*a*, 32*b*, two vertical walls 33*a*, 33*b*, two concave ridge line portions 34*a*, 34*b*, and two flanges 35*a*, 35*b*. Moreover, in the present specification, "pressing" refers to a process of setting a forming target in a mold, closing the mold, and then opening the mold. Note that in the present exemplary embodiment, the blank BL and the intermediate formed component 30 are examples of forming targets. Further, a first mold 20 and a second mold 40, described later, are examples of molds.

First Press Device

The first press device 18 is configured including the first mold 20 and a first moving device 25. As illustrated in FIG. 2B, the first mold 20 includes an upper mold 21, a lower mold 22, a first holder 23, and a second holder 24. The upper mold 21 is disposed at the upper side, and the lower mold 22 is disposed at the lower side. The first press device 18 is an example of a press device. The first mold 20 is an example of a mold. The upper mold 21 is an example of a die. The lower mold 22 is an example of a punch. When forming the blank BL into the intermediate formed component 30, the first press device 18 has a function of, in a state in which the blank BL is in contact with the lower mold 22 at portions of the blank where the two convex ridge line portions 3*a*, 3*b* are to be formed, employing the upper mold 21 and the lower mold 22 to bend the blank BL into a profile protruding from the lower mold 22 side toward the upper mold 21 side, before sandwiching the portion of the blank BL where the top plate 2 is to be formed between the upper mold 21 and the lower mold 22 and indenting the portion of the blank BL where the top plate 2 is to be formed from the upper mold 21 side toward the lower mold 22 side, such that the portion of the blank BL where the top plate 2 is to be formed has a radius of curvature R (mm) that satisfies the following Equation (1). The portions of the blank BL where the two convex ridge line portions 3*a*, 3*b* are to be formed are an example of a first portion. Further, the portion of the blank BL where the top plate 2 is to be formed is an example of a second portion.

$$\frac{t \cdot E \cdot 1000}{2|\sigma_s - \sigma_m|} \times 0.5 \leq R \leq \frac{t \cdot E \cdot 1000}{2|\sigma_s - \sigma_m|} \times 4 \quad (1)$$

Each parameter in Equation (1) is as follows.

t is a plate thickness (mm) of the blank BL;

$\sigma_s$ is a short direction bend outer surface stress (MPa) of the portion of the blank BL to form the top plate;

$\sigma_m$ is an average stress in cross section of short direction (MPa) of the portion of the blank BL to form the top plate; and E is a Young's Modulus (GPa) of sheet steel configuring the blank BL.

Note that the first press device 18 is configured so as to sandwich the second portion between the upper mold 21 and the lower mold 22 and to indent the second portion from the upper mold 21 side toward the lower mold 22 side such that a portion of the second portion contacting the lower mold 22 satisfies the radius of curvature R (mm) in Equation (1).

Further, of the parameters in Equation (1), $\sigma_s$ and $\sigma_m$ are found by performing forming analysis of conditions to achieve a flat top plate 2.

For a high tensile sheet steel blank having 980 MPa grade tensile strength, the radius of curvature R (mm) in Equation (1) is from 38 mm to 1300 mm. Moreover, for a high tensile sheet steel blank having 1310 MPa grade tensile strength, the radius of curvature R (mm) in Equation (1) is from 32 mm to 1020 mm. Moreover, for a high tensile sheet steel blank having 1470 MPa grade tensile strength, the radius of curvature R (mm) in Equation (1) is from 30 mm to 725 mm. Accordingly, when sandwiching the portion of the blank BL that will form the top plate 2 between the upper mold 21 and the lower mold 22 and indenting this portion from the upper mold 21 side toward the lower mold 22 side such that the radius of curvature R (mm) of the portion of the blank BL that will form the top plate 2 is within a range of from 38 mm to 725 mm, pressing that satisfies Equation (1) is performed on a high tensile sheet steel blank having at least a strength within a range of from 980 MPa grade to 1470 MPa grade. As described above, it may be said that when the blank BL is formed into the intermediate formed component 30, the first press device 18 has a function to sandwich the portion of the blank BL that will form the top plate 2 between the upper mold 21 and the lower mold 2 and to indent the portion of the blank BL that will form the top plate 2 from the upper mold 21 side toward the lower mold 22 side such that the radius of curvature R (mm) of the portion of the blank BL that will form the top plate 2 is within a range of from 38 mm to 725 mm.

Figure 2A:
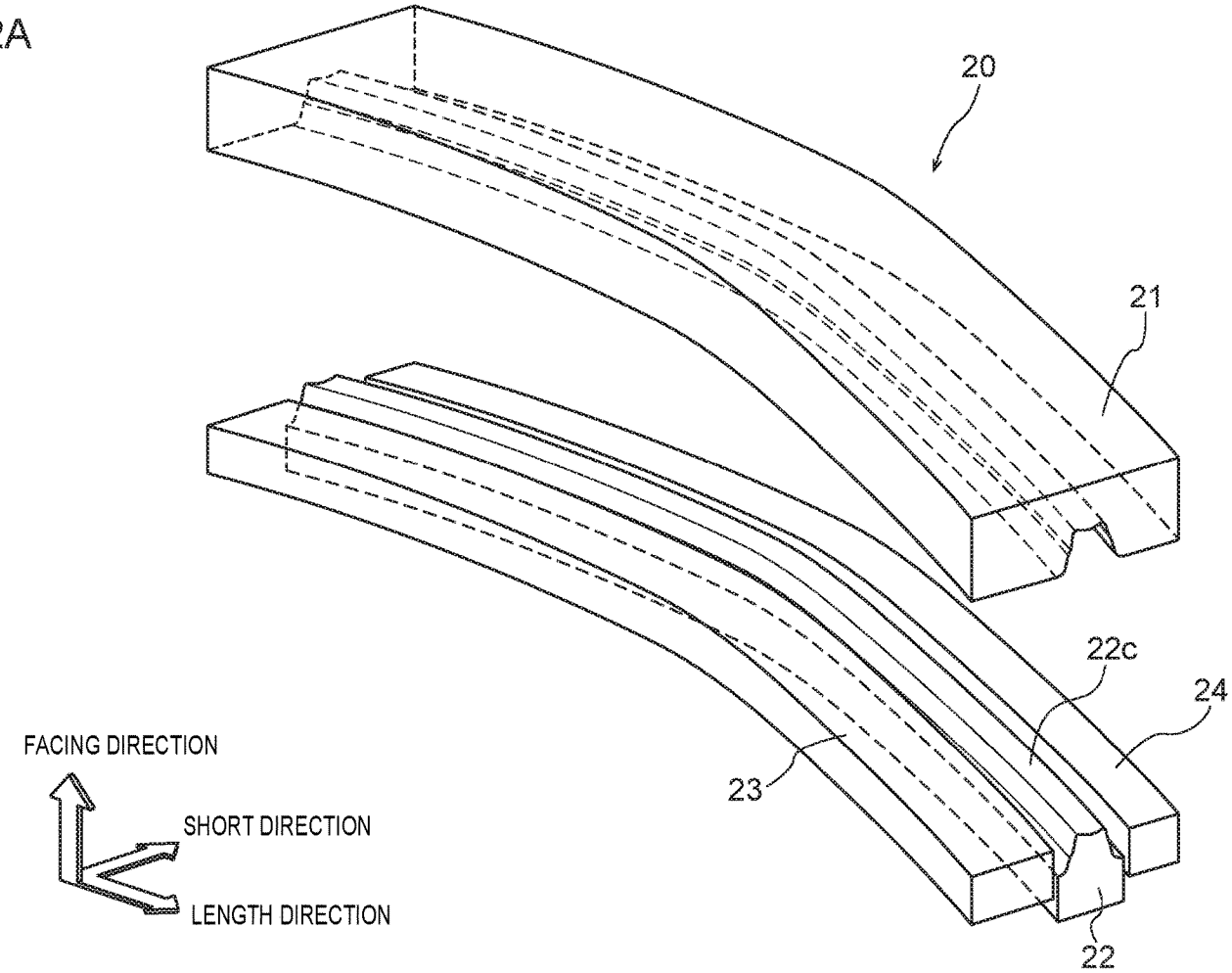
FIG. 2A is a perspective view of a mold of a first press device employed in a first pressing process of a manufacturing method of a roof member of the first exemplary embodiment.

As illustrated in FIG. 2A, the upper mold 21 and the lower mold 22 are each elongated. An apex face of the lower mold 22 projects out and is curved along the length direction when the upper mold 21 and the lower mold 22 are viewed along the direction in which the upper mold 21 and the lower mold 22 face each other, and a groove that curves so as to follow the apex face of the lower mold 22 is formed in the upper mold 21, as illustrated in FIG. 2A and FIG. 2B. Further, when the upper mold 21 and the lower mold 22 are viewed along the short direction of the upper mold 21 and the lower mold 22, this being a direction orthogonal to the direction in which the upper mold 21 and the lower mold 22 face each other, the apex face of the lower mold 22 is curved in a convex profile bowing toward the upper mold 21 side, and the groove that curves following the apex face of the lower mold 22 is formed in the upper mold 21, as illustrated in FIG. 2A and FIG. 2B. An apex face 22*c* of the lower mold 22 is configured by a recessed face having a radius of curvature R (mm) of from 38 mm to 725 mm. Moreover, as viewed along the length direction, the groove-bottom of the groove of the upper mold 21 projects out with a radius of curvature R (mm) toward the lower mold 22 side, and a portion of the lower mold 22 opposing the bottom of the groove of the upper mold 21 (apex face) is recessed toward the upper mold 21 side with a radius of curvature R (mm) (see FIG. 2B). The radius of curvature R (mm) of the present exemplary embodiment is, for example, 100 mm.

Figure 2B:
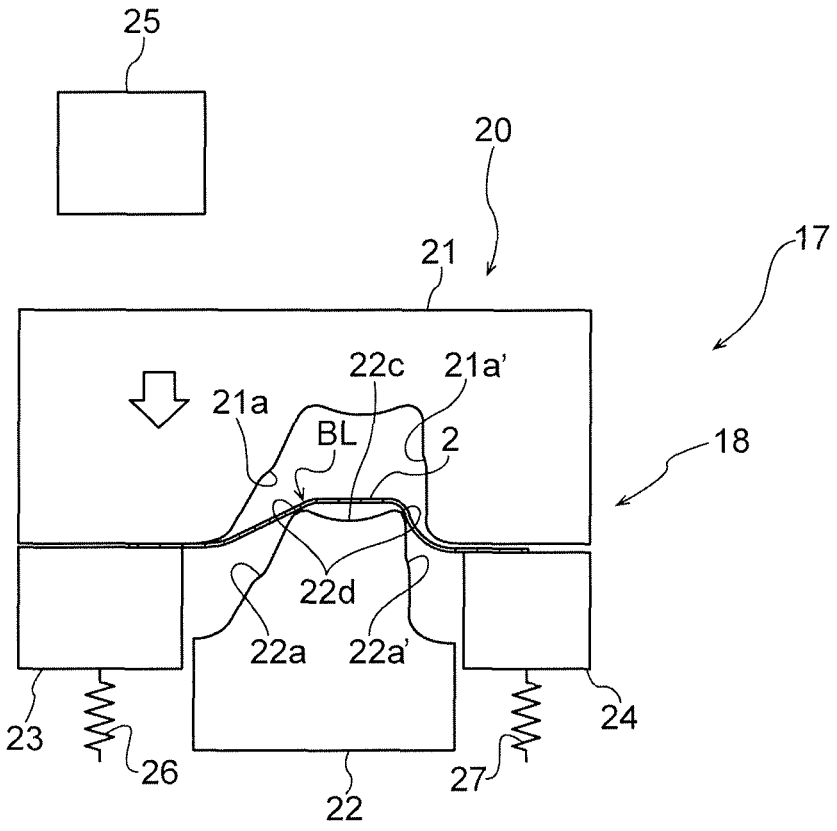
FIG. 2B is a vertical cross-section of a first press device employed in a first pressing process of a manufacturing method of a roof member of the first exemplary embodiment.

Note that as illustrated in FIG. 2A and FIG. 2B, the two short direction ends of the apex face 22*c* of the lower mold 22 are referred to as shoulders 22*d*. When the first press device 18 forms the blank BL into the intermediate formed component 30, each shoulder 22*d* corresponds to a portion of the lower mold 22 contacting the second portion of the blank BL.

Further, when the lower mold 22 is viewed along the length direction, step portions 22*a*, 22*a*' are respectively formed at the two side faces of the lower mold 22, as illustrated in FIG. 2B. Further, step portions 21*a*, 21*a*' that follow the step portions 22*a*, 22*a*' are respectively formed to the two side faces of the groove in the upper mold 21.

The first holder 23 and the second holder 24 are elongated following the upper mold 21 and the lower mold 22. As illustrated in FIG. 2B, the first holder 23 and the second holder 24 are respectively disposed at the two short direction sides of the lower mold 22. Further, the first holder 23 and the second holder 24 are biased toward the upper side by springs 26, 27.

The first moving device 25 is configured so as to move the upper mold 21 toward the lower mold 22. Namely, the first moving device 25 is configured so as to move the upper mold 21 relative to the lower mold 22. When the first moving device moves the upper mold 21 toward the lower mold 22 in a state in which the blank BL is disposed at a predetermined position in a gap between the upper mold 21 and the lower mold 22, as illustrated in FIG. 2B, the blank BL is pressed so as to form the intermediate formed component 30 in a state in which both short direction end sides of the blank BL are sandwiched between the respective first holder 23 and the second holder 24, and the upper mold 21.

In the above explanation, the first press device 18 is configured to curve the second portion of the blank BL in a convex profile bowing from the upper mold 21 side toward the lower mold 22 side such that the second portion has a radius of curvature R mm that satisfies Equation (1). However, the first press device 18 may curve the second portion of the blank BL in a convex profile bowing from the upper mold 21 side toward the lower mold 22 side such that the second portion has a radius of curvature R (mm) that satisfies Equation (2) instead of Equation (1).

$$\frac{t \cdot E \cdot 1000}{2 \cdot \sigma_{TS}} \leq R \leq \frac{t \cdot E \cdot 1000}{\sigma_{YP}} \tag{2}$$

Note that each parameter in Equation (2) is as follows:

t is a plate thickness (mm) of the blank;

$\sigma_{TS}$ is a tensile strength (MPa) of the blank;

$\sigma_{YP}$ is a yield stress (MPa) of the blank; and

E is a Young's Modulus (GPa) of sheet steel configuring the blank.

$\sigma_{TS}$ is, for example, a shipment test value from the mill sheet listing obtained based on Tensile Testing for a JIS No. 5 sample. Further, $\sigma_{YP}$ is, for example, a shipment test value from the mill sheet listing obtained based on Tensile Testing for a JIS No. 5 sample.

The inventors of the present application have made investigation pertaining to numerical value analysis of stress generated at the outer surface, namely an upper face, and at the inner surface, namely a back face, of the top plate 2 when forming the roof member 1 and roof members 1A, 1B, described later, with the plate thickness and material strength of the blank BL, the shape of the top plate 2, the pressing method, such as bending or drawing, and so on serving as the parameters. It was discovered from the results that when the roof members 1, 1A, and 1B are pressed without using a pad, deviatoric stress $\sigma$ that contributes to warping of the top plate 2 changes depending on the material strength of the blank BL and satisfies the following condition A.

$$0.5\ \sigma_{YP} \leq \sigma \leq \sigma_{TS} \qquad \text{Condition A:}$$

Further, based on the assumption that deformation of the top plate 2 during pressing is elastic deformation, relationship B between the radius of curvature R (mm), the deviatoric stress σ (MPa), the plate thickness (mm) of the blank BL, and the Young's Modulus (GPa) of the sheet steel configuring the blank BL satisfy the following relationship.

$$\sigma = E \times 1000 \times t/2R \quad \text{Relationship B:}$$

Equation (2) is derived from condition A and relationship B above.

Note that of the parameters in Equation (2), $\sigma_{TS}$ and $\sigma_{YP}$ are found by performing forming analysis under the condition of forming a flat top plate 2.

Second Press Device

The second press device 19 is configured including the second mold 40 and a second moving device 45. As illustrated in FIG. 3B, the second mold 40 includes an upper mold 41, a lower mold 43, and a holder 42. The upper mold 41 is disposed at the upper side, and the lower mold 43 is disposed at the lower side. In the second press device 19, in a state in which the intermediate formed component 30 has been fitted onto the lower mold 43, the upper mold 41 is moved toward the lower mold 43 side by the second moving device so as to change the angles of the two flanges 35*a*, 35*b* of the intermediate formed component 30.

Further, when viewing the lower mold 43 along the short direction, step portions 43*a* are respectively formed at the two side faces of the lower mold 43, as illustrated in FIG. 3B. Further, step portions 41*a* following the respective step portions 43*a* are formed at the two side faces of the groove of the upper mold 41.

The foregoing was an explanation relating to configuration of the press apparatus 17 of the present exemplary embodiment.

Roof Member Manufacturing Method

Explanation follows regarding a manufacturing method of the roof member 1 of the present exemplary embodiment, with reference to the drawings. The manufacturing method of the roof member 1 of the present exemplary embodiment is performed using the press apparatus 17. Further, the manufacturing method of the roof member 1 of the present exemplary embodiment includes a first pressing process, this being a process performed by the first press device 18, and a second pressing process, this being a process performed by the second press device 19.

First Pressing Process

In the first pressing process, the blank BL is disposed at the predetermined position in the gap between the upper mold 21 and the lower mold 22, namely, the blank BL is set in the mold 20 at a predetermined position. Next, an operator operates the first press device 18 such that the upper mold 21 is moved toward the lower mold 22 side by the first moving device 25, and the blank BL is drawn so as to press the blank BL. When this is performed, first, in a state in which the first portion of the blank BL is in contact with the shoulders 22*d* of the lower mold 22, the first press device 18 bends the blank BL into a profile protruding from the lower mold 22 side toward the upper mold 21 side, as illustrated in FIG. 2B. Next, the first press device 18 sandwiches the second portion of the blank BL between the upper mold 21 and the lower mold 22 and indents the second portion from the upper mold 21 side toward the lower mold 22 side. Namely, in the first pressing process, the upper mold 21 and the lower mold 22 are used to press the blank BL. The intermediate formed component 30 is formed from the blank BL as a result.

Note that the mold 20 employed in the first pressing process is manufactured according to the parameters of the blank BL so as to satisfy the conditions of Equation (1) or Equation (2). For example, the first pressing process is performed using an upper mold 21 and lower mold 22, namely the mold 20, manufactured according to the plate thickness t of the blank BL and the Young's modulus E of the sheet steel configuring the blank BL so as to satisfy Equation (1) or Equation (2). Further, for example, plural molds 40 having different shapes to each other are prepared, and the first pressing process is performed after selecting the mold 20 according to the plate thickness t of the blank BL and the Young's Modulus E of the sheet steel configuring the blank BL so as to satisfy Equation (1) or Equation (2), and attaching the selected mold 20 to the body of the first press device 18.

Further, in the first pressing process, as illustrated in FIG. 5A, FIG. 5B, FIG. 6A, and FIG. 6B, steps 36*a*, 36*a*' having a step amount a1 (mm) as defined by the following Equation (3) and Equation (4) are respectively formed on the two vertical walls 33*a*, 33*b* of the intermediate formed component 30, at portions thereof at a distance of not less than 40% of the height h, h' away from the top plate 2.

$$a1 \geq a2 \quad (3)$$

$$a1 \leq 0.2\ W \quad (4)$$

Note that the reference sign a1 indicates the step amount (mm) of the intermediate formed component 30, the reference sign a2 indicates the step amount (mm) of the roof member 1, and the reference sign W indicates the short direction width (mm) of the top plate 2 of the roof member 1.

Figure 7A:
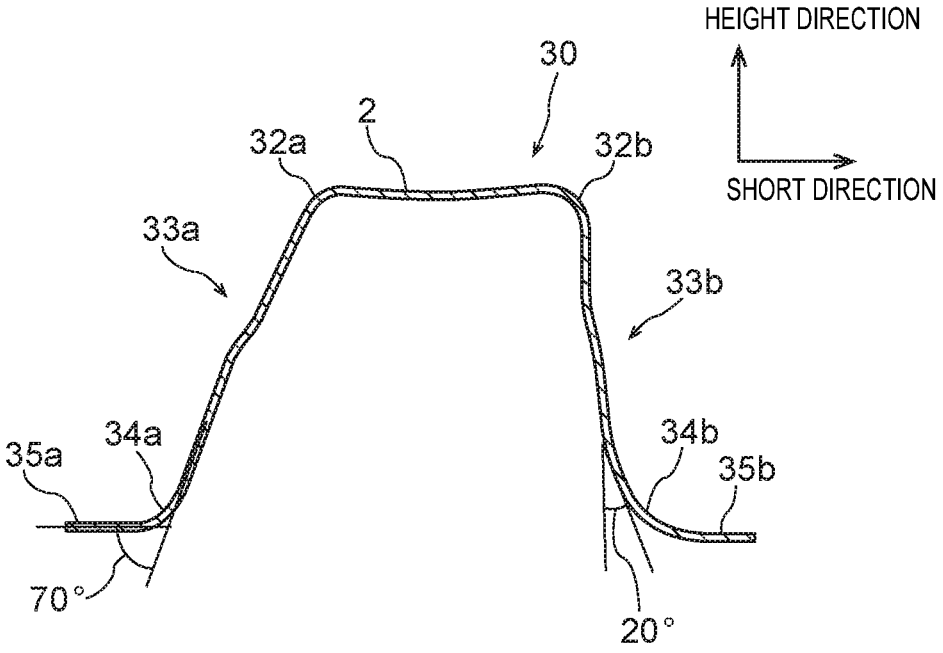
FIG. 7A is a cross-section taken along 1C-1C in FIG. 1A of an intermediate formed component formed by a first pressing process of the first exemplary embodiment, and is a cross-section that illustrates angles formed between vertical walls and flanges in detail.
Figure 7B:
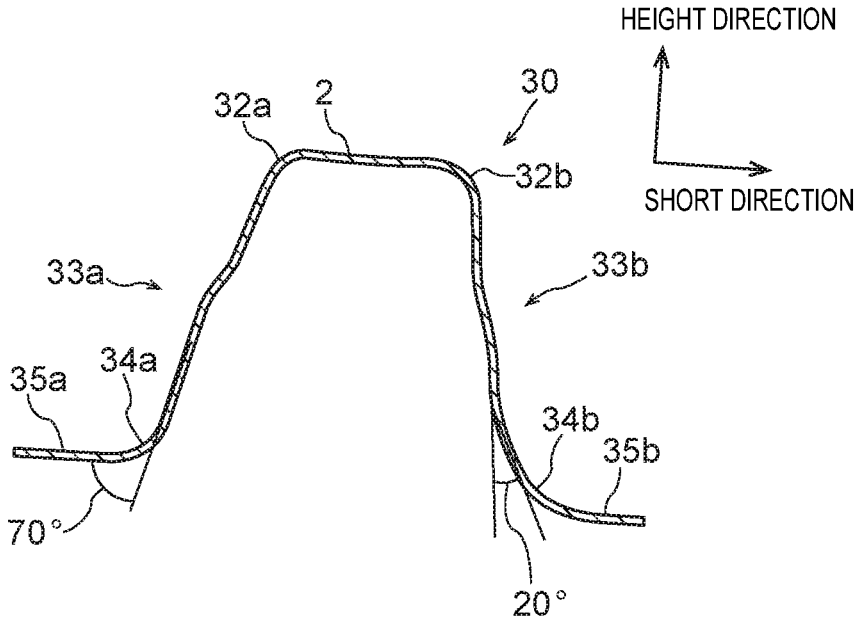
FIG. 7B is a cross-section taken along 1D-1D in FIG. 1A of an intermediate formed component formed by a first pressing process of the first exemplary embodiment, and is a cross-section that illustrates angles formed between vertical walls and flanges in detail.
Figure 7C:
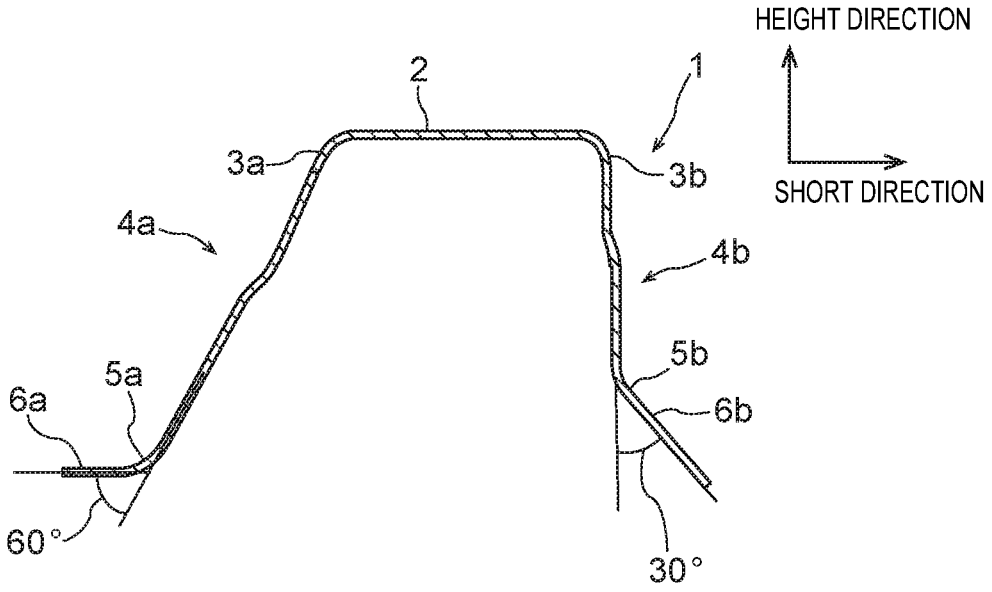
FIG. 7C is a cross-section taken along 1C-1C in FIG. 1A of a roof member manufactured by undergoing a second pressing process of the first exemplary embodiment, and is a cross-section that illustrates angles formed between vertical walls and flanges in detail.
Figure 7D:
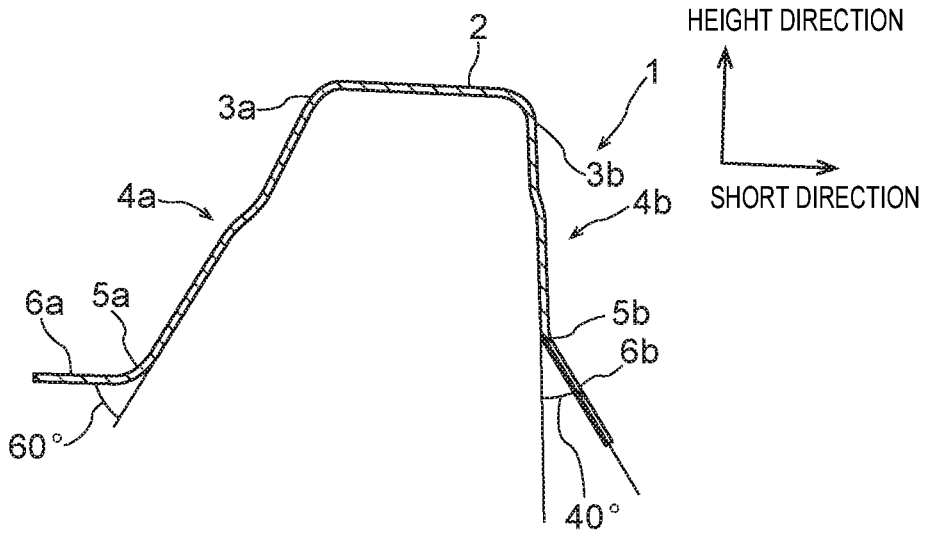
FIG. 7D is a cross-section taken along 1D-1D in FIG. 1A of a roof member manufactured by undergoing a second pressing process of the first exemplary embodiment, and is a cross-section that illustrates angles formed between vertical walls and flanges in detail.
Figure 8A:
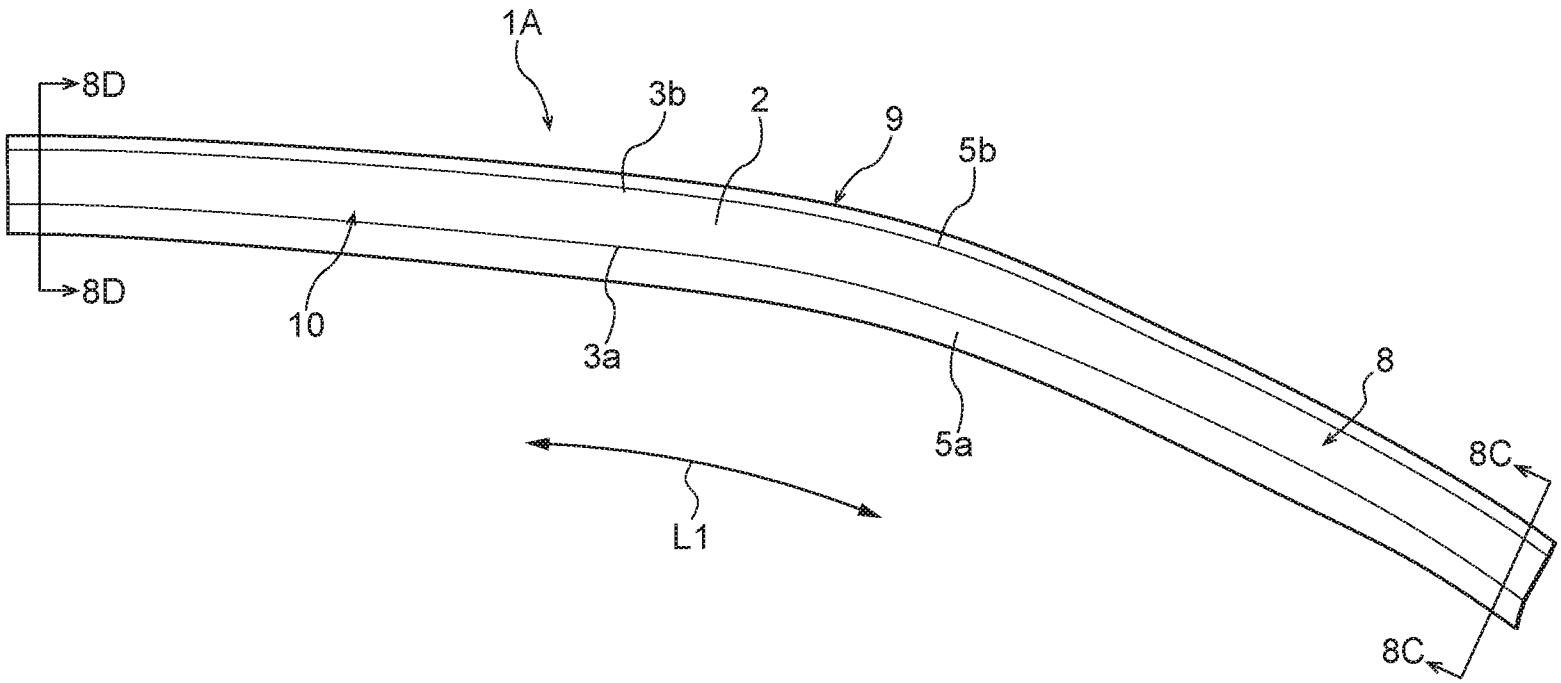
FIG. 8A is a top view illustrating a roof member of a second exemplary embodiment.
Figure 8B:
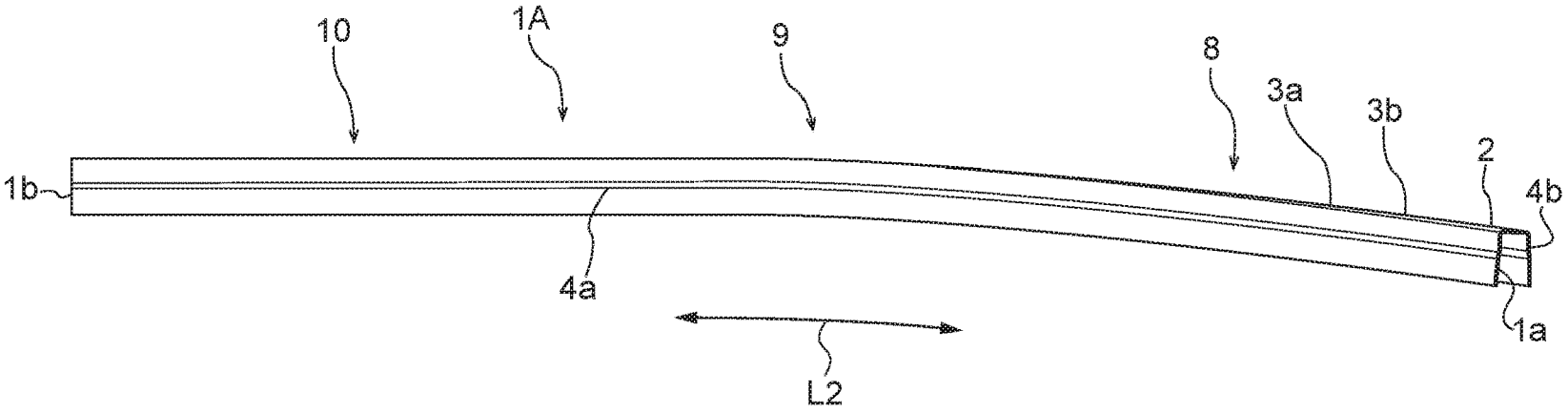
FIG. 8B is a side view illustrating a roof member of the second exemplary embodiment.
Figure 8C:
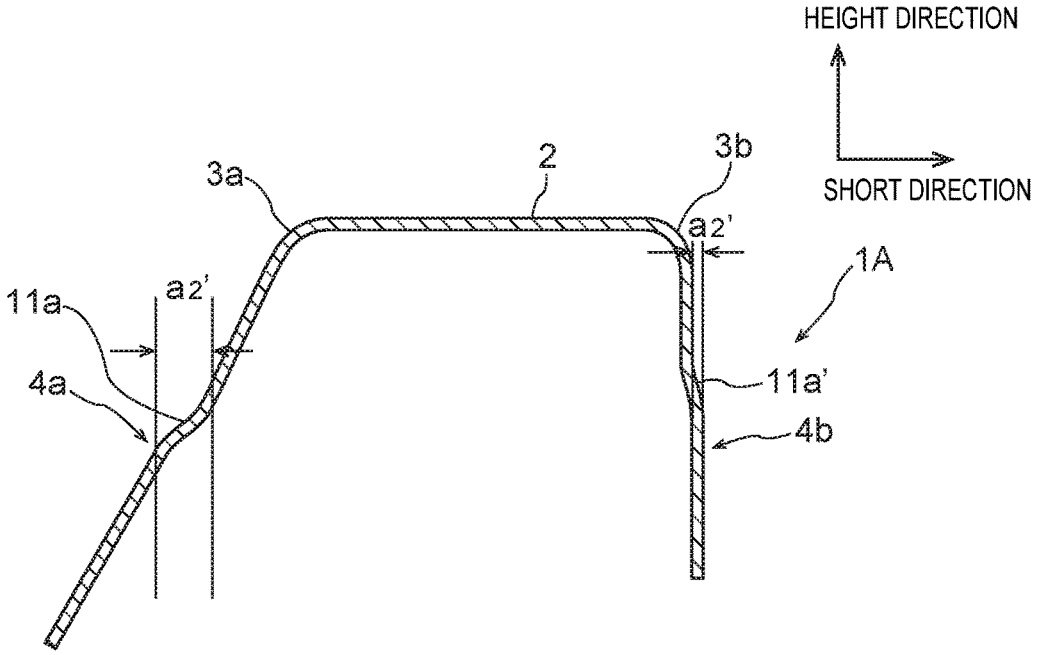
FIG. 8C is a cross-section taken along 8C-8C in FIG. 8A.
Figure 8D:
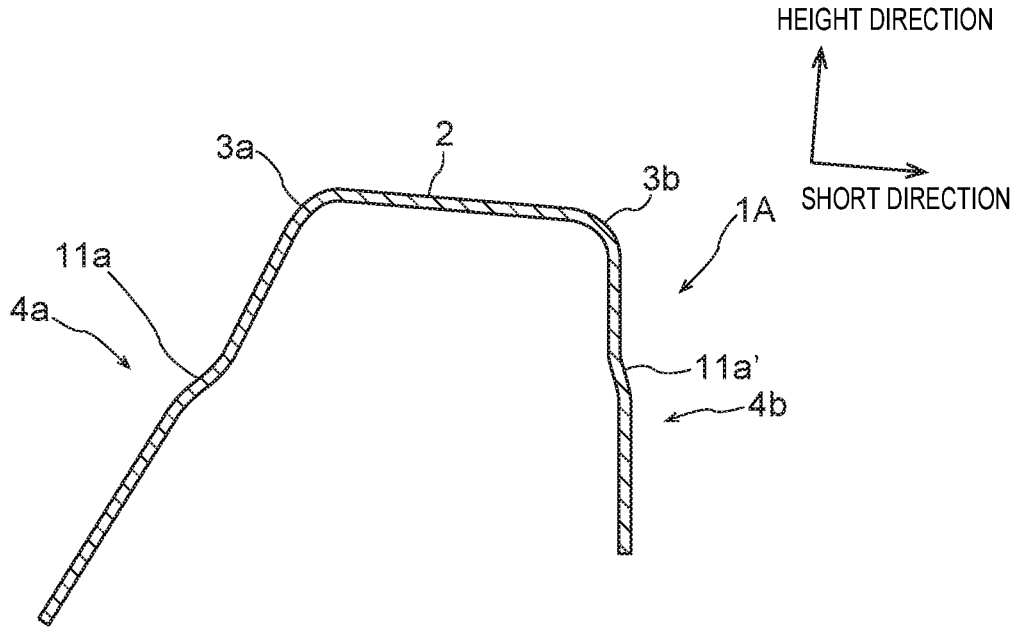
FIG. 8D is a cross-section taken along 8D-8D in FIG. 8A.

Further, in the first pressing process, as illustrated in FIG. 7A and FIG. 7B, the vertical wall 33*a* and the flange 35*a* are formed such that an angle DI1 formed between the vertical wall 33*a* and the flange 35*a* of the intermediate formed component 30 satisfies the following Equation (5).

$$1.0 \times DI2 \leq DI1 \leq 1.2 \times DI2 \quad (5)$$

The reference sign DI1 indicates the angle formed between the vertical wall 33*a* and the flange 35*a* of the intermediate formed component 30, and the reference sign DI2 indicates the angle formed between the vertical wall 4*a* and the flange 6*a* of the roof member 1.

Further, in the first pressing process, the vertical wall 33*b* and the flange 35*b* of the intermediate formed component 30 are formed so as to satisfy the following Equation (6).

$$0.9 \leq DOF1/DOR1 \leq 1 \quad (6)$$

Note that DOF1 is the angle formed between the flange 35*b* and the vertical wall 33*b* including one end portion of the intermediate formed component 30, and DOR1 is the angle formed between the flange 35*b* and the vertical wall 33*b* including another end portion of the intermediate formed component 30.

Further, in the first pressing process, an end of the material of the blank BL flows in and the blank BL is flexed so as to form the flange 35*b* at the outside of the intermediate formed component 30.

The intermediate formed component 30 is then removed from the first mold 20, thereby completing the first pressing process.

Figure 4A:
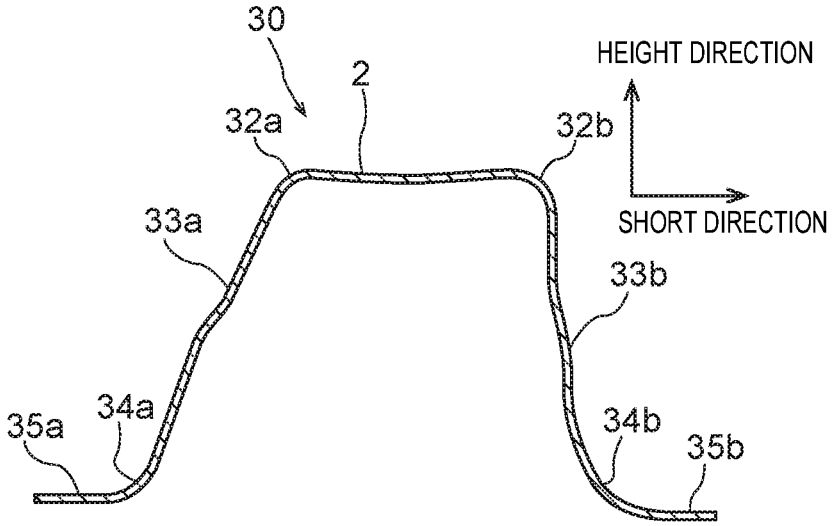
FIG. 4A is a cross-section of an intermediate formed component formed by a first pressing process of the first exemplary embodiment, taken along 1C-1C in FIG. 1A.
Figure 4B:
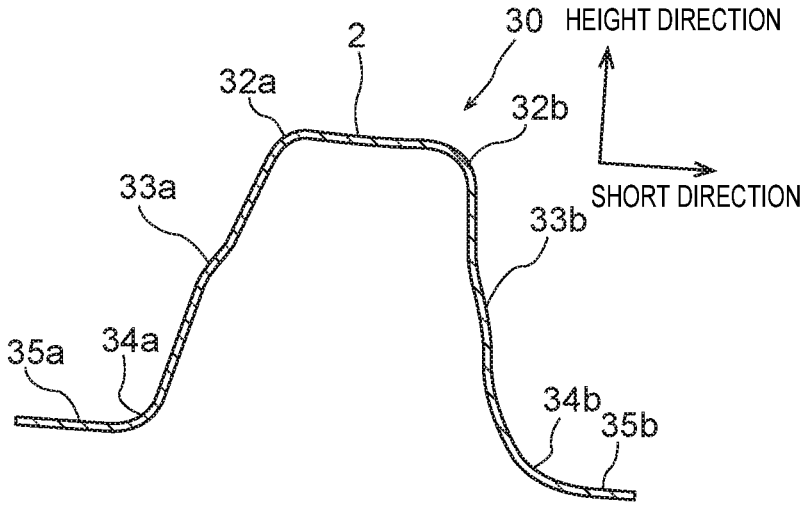
FIG. 4B is a cross-section of an intermediate formed component formed by a first pressing process of the first exemplary embodiment, taken along 1D-1D in FIG. 1A.
Figure 4C:
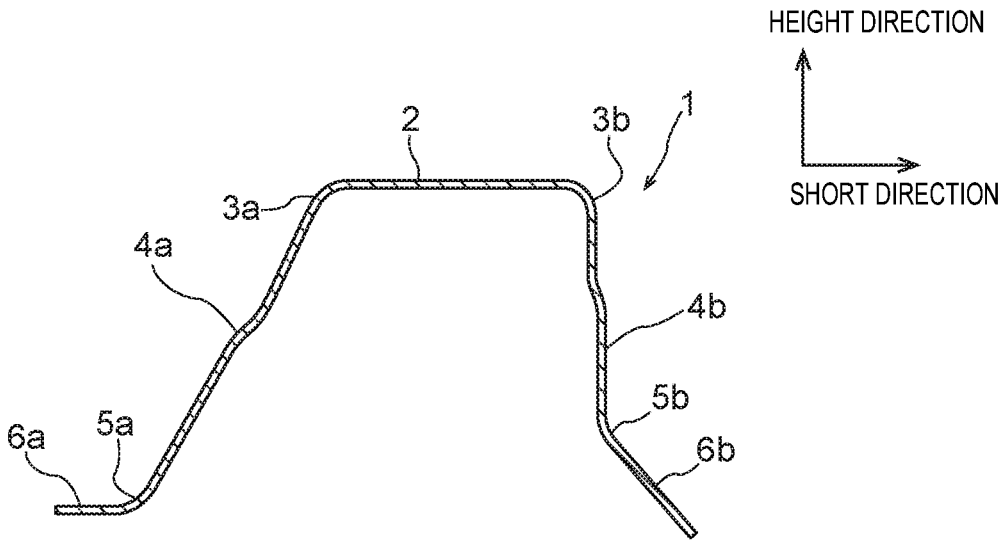
FIG. 4C is a cross-section of a roof member manufactured by undergoing a second pressing process of the first exemplary embodiment, taken along 1C-1C in FIG. 1A.
Figure 4D:
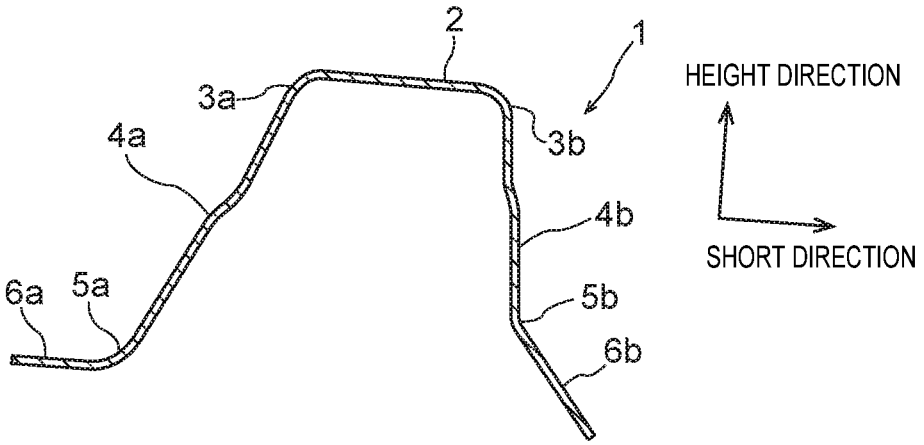
FIG. 4D is a cross-section of an intermediate formed component formed by undergoing a second pressing process of the first exemplary embodiment, taken along 1D-1D in FIG. 1A.
Figure 5A:
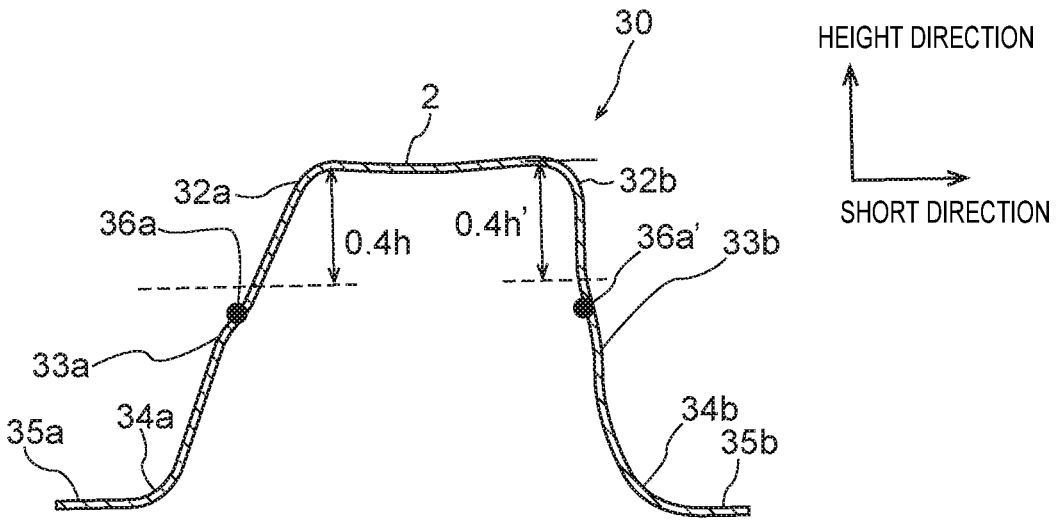
FIG. 5A is a cross-section of an intermediate formed component formed by a first pressing process of the first exemplary embodiment, and illustrates the cross-section taken along 1C-1C in FIG. 1A in detail.
Figure 5B:
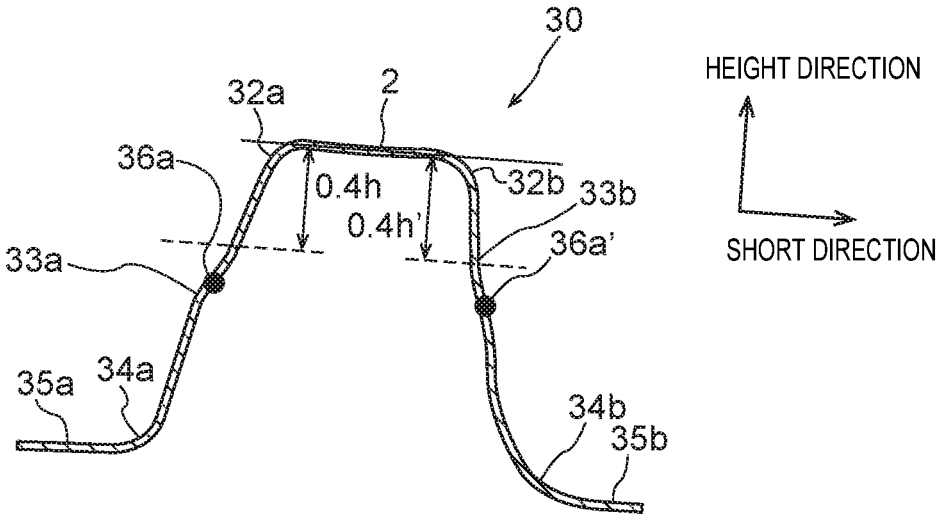
FIG. 5B is a cross-section of an intermediate formed component formed by a first pressing process of the first exemplary embodiment, and illustrates the cross-section taken along 1D-1D in FIG. 1A in detail.
Figure 5C:
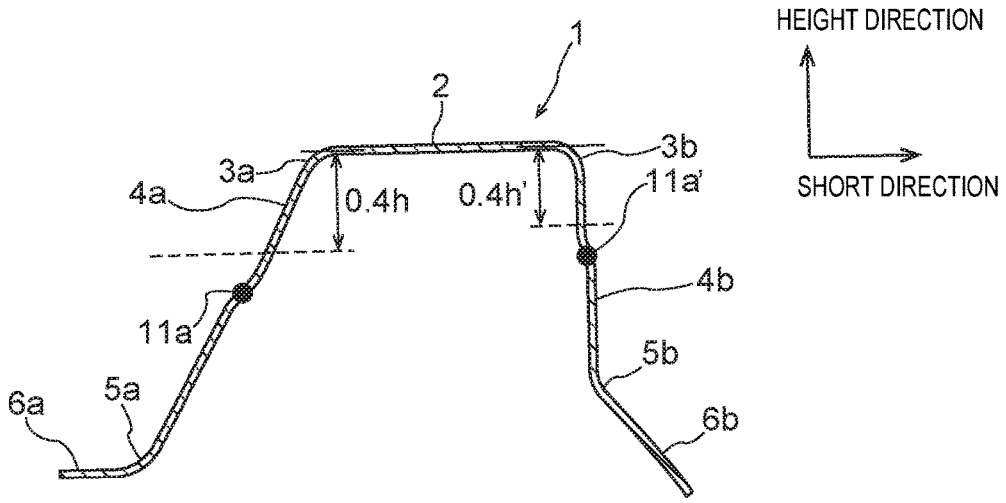
FIG. 5C is a cross-section of a roof member manufactured by undergoing a second pressing process of the first exemplary embodiment, and illustrates the cross-section taken along 1C-1C in FIG. 1A in detail.
Figure 5D:
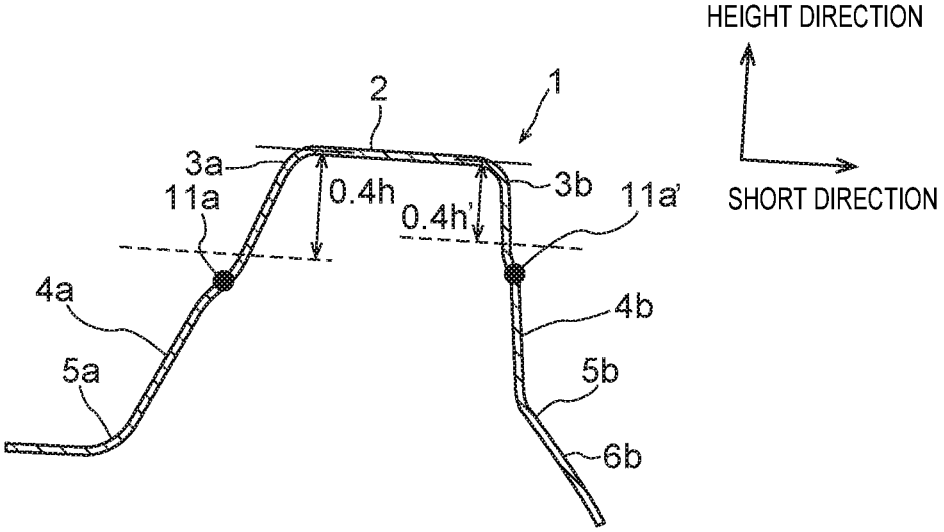
FIG. 5D is a cross-section of a roof member manufactured by undergoing a second pressing process of the first exemplary embodiment, and illustrates the cross-section taken along 1D-1D in FIG. 1A in detail.
Figure 6A:
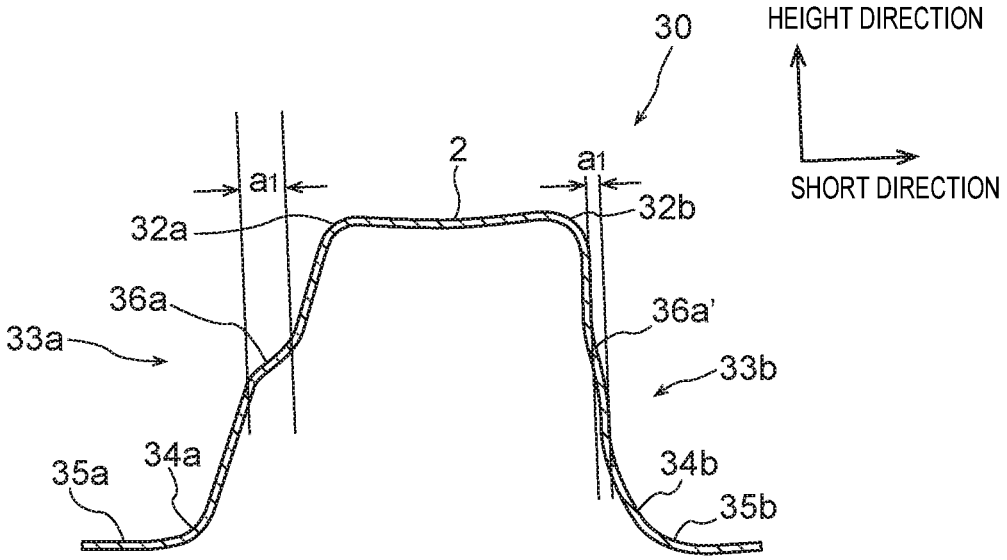
FIG. 6A is a cross-section of a length direction central portion of an intermediate formed component formed by a first pressing process of the first exemplary embodiment.
Figure 6B:
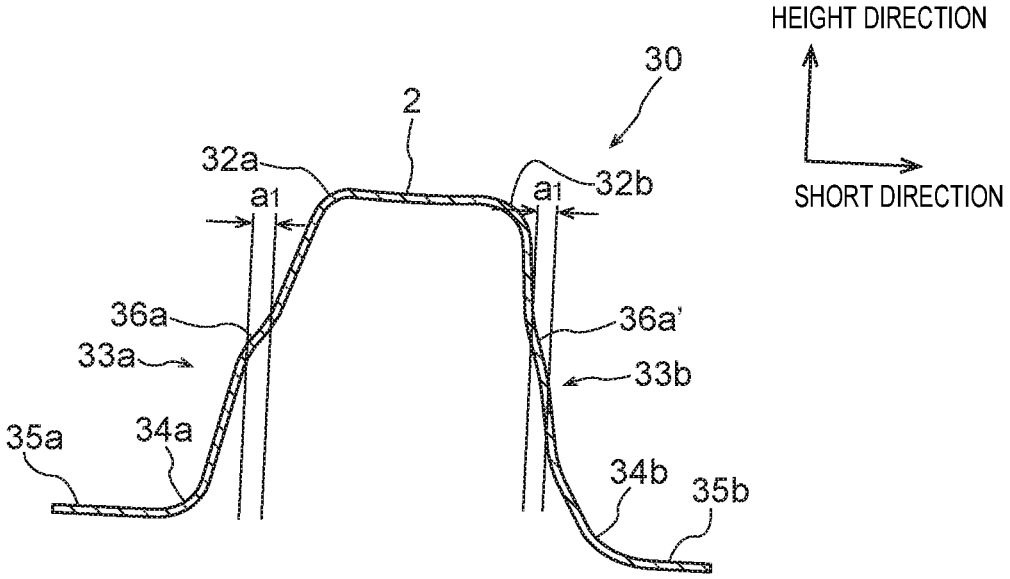
FIG. 6B is a cross-section of a portion of an intermediate formed component formed by a first pressing process of the first exemplary embodiment that corresponds to a cross-section taken along 1C-1C in FIG. 1A.
Figure 6C:
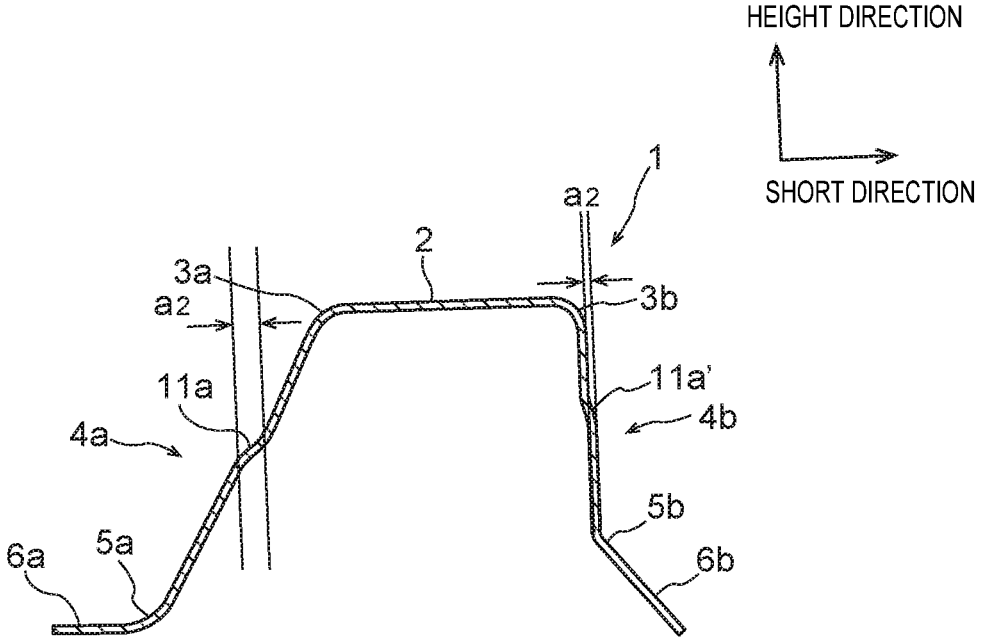
FIG. 6C is a cross-section of a length direction central portion of a roof member manufactured by undergoing a second pressing process of the first exemplary embodiment.
Figure 6D:
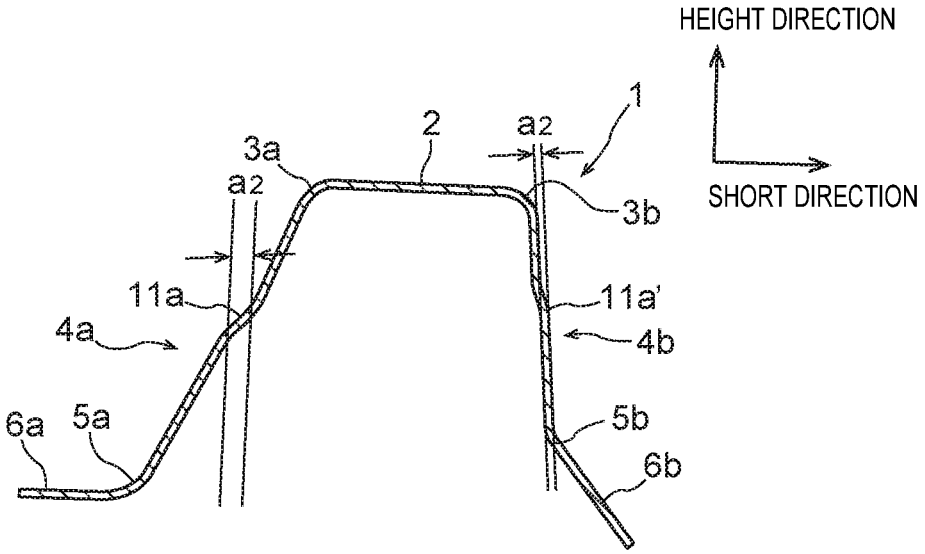
FIG. 6D is a cross-section of a roof member manufactured by undergoing a second pressing process of the first exemplary embodiment, taken along 1C-1C in FIG. 1A.

Note that as described above, when the intermediate formed component 30 is formed by the first press device 18, the second portion of the blank BL is indented from the upper mold 21 side toward the lower mold 22 side such that the radius of curvature R (mm) of the second portion satisfies Equation (1) or Equation (2). When the first mold 20 is opened, as illustrated in FIG. 4A and FIG. 4B, the cross-section of the intermediate formed component 30 in the length direction of the top plate 2 adopts a deformed state that is flatter than when the mold was closed, namely, a state in which the radius of curvature has become larger.

Second Pressing Process

Next, the intermediate formed component 30 is fitted onto the lower mold 43 of the second mold 40 of the second press device 19. Then, when an operator operates the second press device 19, the upper mold 41 is moved toward the lower mold 43 side by the second moving device, and the angles of the two flanges 35*a*, 35B of the intermediate formed component 30 are changed. The roof member 1 is thus manufactured from the intermediate formed component 30. Note that in the second pressing process, the intermediate formed component 30 is pressed such that the step amounts of the vertical walls 33*a*, 33*b* of the intermediate formed component 30 become a2. Further, in the second pressing process, as illustrated in FIG. 7A, FIG. 7B, FIG. 7C, and FIG. 7D, the intermediate formed component 30 is sandwiched between the upper mold 41 and the lower mold 43 and the intermediate formed component 30 is then pressed such that the vertical wall 33*a* and the flange 35*a* of the intermediate formed component 30 form the vertical wall 4*a* and the flange 6*a* of the roof member 1. Further, in the second pressing process, as illustrated in FIG. 7A, FIG. 7B, FIG. 7C, and FIG. 7D, the intermediate formed component 30 is sandwiched between the upper mold 41 and the lower mold 43, and between the upper mold 41 and the holder 42, and the intermediate formed component 30 is then pressed such that the vertical wall 33*b* and the flange 35*b* of the intermediate formed component 30 form the vertical wall 4*b* and the flange 6*b* of the roof member 1.

The foregoing was an explanation relating to the manufacturing method of the roof member 1 of the present exemplary embodiment.

Advantageous Effects

Next, explanation follows regarding advantageous effects of the present exemplary embodiment, with reference to the drawings.

Advantageous Effect of Causing Prior Contact of Lower Mold 22 Against First Portion of Blank BL An advantageous effect of causing prior contact of the lower mold 22 against the first portion of the blank BL (referred to below as first portion prior contacting advantageous effect), is an advantageous effect in which, as illustrated in FIG. 2B, the blank BL is bent into a profile protruding from the lower mold 22 side toward the upper mold 21 side in a state in which the shoulders 22*d* of the lower mold 22 are caused to contact the first portion of the blank BL, prior to then sandwiching the blank BL between the upper mold 21 and the lower mold 22 and indenting the blank BL from the upper mold 21 side toward the lower mold 22 side. In other words, this is an advantageous effect to form the first portion of the blank BL before the second portion. Explanation follows regarding the first portion prior contacting advantageous effect by comparing the present exemplary embodiment to a first comparative embodiment described below. Note that in the first comparative embodiment, where components and the like employed in the present exemplary embodiment are also employed, the same names and the like are used for such components, even if they are not illustrated in the drawings.

In the case of the first comparative embodiment, the second portion of the blank BL is formed prior to the first portion. Thus, in the case of the first comparative embodiment, compressive stress arises in the top plate 2 during mold closure in the first pressing process as a result of surplus material that arises when indenting the blank BL. As a result, in the case of the first comparative embodiment, spring-back occurs in the intermediate formed component 30 after the mold is opened in the first pressing process.

By contrast, in the case of the present exemplary embodiment, as illustrated in FIG. 2A, the blank BL is bent into a profile protruding from the lower mold 22 side toward the upper mold 21 side in a state in which the shoulders 22*d* of the lower mold 22 are caused to contact the first portion of the blank BL, prior to then sandwiching the blank BL between the upper mold 21 and the lower mold 22 and indenting the blank BL from the upper mold 21 side toward the lower mold 22 side. Namely, in the case of the present exemplary embodiment, the first portion is formed before the second portion, thereby enabling a reduction in surplus material when indenting the blank BL compared to in the case of the first comparative embodiment. Accordingly, in the case of the present exemplary embodiment, compressive stress that arises in the top plate 2 during mold closure in the first pressing process can be reduced compared to in the case of the first comparative embodiment.

The manufacturing method of the roof member 1 of the present exemplary embodiment thereby enables the roof member 1 to be manufactured such that closing in of the vertical walls 4*a*, 4*b* due to spring-back is suppressed compared to in the first comparative embodiment.

Advantageous Effect of Performing First Pressing to Obtain Radius of Curvature R Satisfying Equation (1)

An advantageous effect of performing the first pressing so as to obtain a radius of curvature R satisfying Equation (1) (referred to below as advantageous effect of accordance to Equation (1)) is an advantageous effect in which the second portion is indented from the upper mold 21 side toward the lower mold 22 side in the first pressing process such that the portion of the blank BL that will form the top plate 2 attains a radius of curvature R (mm) satisfying Equation (1), in other words, attains a radius of curvature satisfying Equation (2), or in yet other words, such that the radius of curvature R (mm) of the second portion of the blank BL is within a range of from 38 mm to 725 mm. Explanation follows regarding the advantageous effect of accordance to Equation (1) by comparing the present exemplary embodiment to a second comparative embodiment described below. Note that in the second comparative embodiment, where components and the like employed in the present exemplary embodiment are also employed, the same names and the like are used for such components, even if they are not illustrated in the drawings.

In the case of the second comparative embodiment, the bottom of the groove in the upper mold 21 of the first press device 18 is flat in cross-section viewed along its length direction, and a portion of a lower mold 22 opposing the bottom of the groove of the upper mold 21 is flat in cross-section viewed along its length direction. Further, in the case of the second comparative embodiment, step portions 21*a* are not formed to the upper mold 21, and step portions 22*a* are not formed to the lower mold 22. The second comparative embodiment is similar to the present exemplary embodiment with the exception of the points described above.

In the case of the second comparative embodiment, twisting occurs in the top plate 2 due to residual deviatoric stress in the top plate 2 when the intermediate formed component 30 is formed in the first pressing process. As a result, a roof member 1 manufactured by a manufacturing method of the roof member 1 of the second comparative embodiment adopts a twisted state, as indicated by Comparative Examples 2 to 6 in the table in FIG. 15. This result is thought to be due to the vertical walls 33*a*, 33*b* closing in due to spring-back after the first pressing, namely, after the mold is opened. Note that in the case of the second comparative embodiment, it is thought that the closing in of the vertical walls 33*a*, 33*b* due to spring-back after the first pressing occurs via the following mechanism. Namely, in the first pressing process, the intermediate formed component 30 is formed by deforming the second portion of the blank BL into a profile protruding toward the upper side by the time that the mold is closed. Namely, in the gap between the upper mold 21 and the lower mold 22, the second portion of the blank BL is formed by being bent into a profile protruding toward the upper side. Thus, the top plate 2 of the intermediate formed component 30 of the second comparative embodiment is bent into a profile protruding toward an outer surface side configuring the outer side in cross-section view. As a result, stress attempting to cause the vertical walls 33*a*, 33*b* to close in occurs in the top plate 2. Moreover, in the case of the second comparative embodiment, the intermediate formed component 30 is curved along its length direction, such that differences in stress can occur between the two short direction end sides of the top plate 2, at respective positions perpendicular to the length direction of the top plate 2. As a result, the roof member 1 manufactured according to the manufacturing method of the roof member 1 of the second comparative embodiment adopts a twisted state.

By contrast, in the case of the present exemplary embodiment, the second portion is indented from the upper mold 21 side toward the lower mold 22 side in the first pressing process such that the portion of the blank BL that will form the top plate 2 attains a radius of curvature R (mm) that satisfies Equation (1), in other words, a radius of curvature that satisfies Equation (2), or in yet other words, such that the radius of curvature R (mm) of the second portion of the blank BL is within a range of from 38 mm to 725 mm. Thus, in the first pressing process of the present exemplary embodiment, the blank BL is deformed into a profile protruding toward the upper side accompanying mold closure, and next, the portion of the blank BL that will form the top plate 2 is deformed to achieve a profile of the top plate 2 curving toward the lower side during mold closure. The mold is then opened, thereby forming the intermediate formed component 30. Namely, it is speculated that after being plastically deformed toward the upper side, the top plate 2 of the intermediate formed component 30 of the present exemplary embodiment bears load from the upper side toward the lower side, thereby attaining a state in which the Bauschinger effect acts. As a result, twisting is less liable to arise in the top plate 2 of the intermediate formed component 30 formed by the first pressing process of the present exemplary embodiment than in the case of the second comparative embodiment. This result is thought to be due to the fact that the amount by which the vertical walls 33*a*, 33*b* close in due to spring-back after the first pressing process is less than that in the case of the second comparative embodiment. Further, although the second pressing process is performed after the first pressing process, the top plate 2 of the intermediate formed component 30 undergoes hardly any deformation in the second pressing process even when pressed. It is thought that as a result there is no twisting or any twisting amount is small in the roof member 1 manufactured according to the manufacturing method of the roof member 1 of the present exemplary embodiment, compared to in the case of the second comparative embodiment, as illustrated by the graph in FIG. 13, described later. Note that in the case of the present exemplary embodiment, the top plate 2 of the intermediate formed component 30 has a (substantially) flat shape in cross-section view along its length direction due to forming the intermediate formed component 30 based on Equation (1) computed on the relationship between t, $\sigma_s$, $\sigma_m$, and E serving as the parameters for the top plate 2, or based on Equation (2) computed on the relationship between t, $\sigma_{TS}$, $\sigma_{YP}$, and E serving as the parameters for the top plate 2. This enables residual deviatoric stress to be suppressed from occurring at the press bottom dead center in the second pressing process performed after the first pressing process. Further, in the case of the present exemplary embodiment, in the first pressing process, the intermediate formed component 30 is completed only after the second portion of the blank BL has been indented from the upper mold 21 side toward the lower mold 22 side. Accordingly, at respective positions perpendicular to the length direction of the top plate 2, the convex ridge line portions 32*a*, 32*b* at the two short direction ends of the top plate 2 can be formed with angles that are more acute than in the case of the second comparative embodiment. As a result, in the case of the present exemplary embodiment, spring-back that attempts to open out the vertical walls 33*a*, 33*b* is canceled out more easily than in the case of the second comparative embodiment. Accordingly, the roof member 1 in the present exemplary embodiment is less liable to twist due to the intermediate formed component 30 curving along its length direction compared to the roof member 1 of the second comparative embodiment, regardless of the fact that differences arise between the stresses at the two short direction end sides of the top plate 2, at the respective positions perpendicular to the length direction of the top plate 2.

Thus, the manufacturing method of the roof member 1 of the present exemplary embodiment enables a roof member 1 to be manufactured that suppresses closing in of the vertical walls 4*a*, 4*b* due to spring-back more effectively than in the second comparative embodiment, namely, compared to cases in which the portion of the blank BL that will form the top plate 2 is pressed flat during mold closure in the first pressing process. Thus, the manufacturing method of the roof member 1 of the present exemplary embodiment enables a roof member 1 to be manufactured that suppresses twisting of the top plate 2 more effectively than in the second comparative embodiment, namely, compared to cases in which the portion of the blank BL that will form the top plate 2 is pressed flat during mold closure in the first pressing process. Further, as illustrated by the graph in FIG. 13, twisting of the top plate 2 of a roof member 1 manufactured by the manufacturing method of the roof member 1 of the present exemplary embodiment is smaller than in a roof member 1 manufactured by the manufacturing method of the roof member 1 of the second comparative embodiment. Further, using the first mold 20, the first press device 18, or the press apparatus 17 of the present exemplary embodiment enables a roof member 1 to be manufactured in which closing in of the vertical walls 4*a*, 4*b* due to spring-back is more effectively suppressed than in the case of the second comparative embodiment. Thus, using the first mold 20, the first press device 18, or the press apparatus 17 of the present exemplary embodiment enables a roof member 1 to be manufactured in which twisting of the top plate 2 is more effectively suppressed from occurring than in the case of the second comparative embodiment.

In particular, the present exemplary embodiment exhibits the advantageous effect of being in accordance with Equation (1) in cases in which a blank BL configured by a high tensile sheet steel is pressed. Further, the advantageous effect of being accordance with Equation (1) is exhibited even in cases in which the top plate 2 is curved along its length direction when viewing the top plate 2 from the upper side, as in the case of the roof member 1 of the present exemplary embodiment. Moreover, the advantageous effect of being in accordance with Equation (1) is exhibited even in cases in which the roof member 1 is curved in a convex profile bowing toward the top plate 2 side when viewing the top plate 2 along the short direction, as in the case of the roof member 1 of the present exemplary embodiment.

Other Advantageous Effects

Explanation follows regarding other advantageous effects of the present exemplary embodiment.

Advantageous Effect 1

In the case of the present exemplary embodiment, in the first pressing process, the steps 36*a*, 36*a*' are formed to the vertical walls 33*a*, 33*b*, and in the second pressing process, the step amount a1 of the steps 36*a*, 36*a*', namely the offset amount, is changed. Thus, the residual stress is reduced in each of the vertical walls 4*a*, 4*b*, such that residual deviatoric stress in the vertical walls 4*a*, 4*b* is also reduced. As a result, residual stress is reduced in upper portions of the vertical walls 4*a*, 4*b* of the roof member 1, namely, portions above the steps 36*a*, 36*a*' and in central portions including the steps 36*a*, 36*a*', such that the occurrence of twisting in the top plate 2 and bending in the vertical walls 33*a*, 33*b* is suppressed, as illustrated by the graph in FIG. 13. Note that in the case of the present exemplary embodiment, stress is reduced throughout the entirety of the vertical walls 33*a*, 33*b* in the second pressing process as a result of forming the steps 36*a*, 36*a*' to the vertical walls 33*a*, 33*b* in the first pressing process. Note that residual stress as it is referred to in the present specification means stress remaining in the material at the press bottom dead center.

Advantageous Effect 2

Generally, when a non-illustrated pressed component is manufactured having a shape curved along its length direction as viewed from the upper side of a top plate, residual tensile stress is liable to occur in vertical walls and flanges at the inside of the curved portion. However, in the case of the present exemplary embodiment, the vertical wall 33*a* and the flange 35*a* are formed in the first pressing process such that the angle DI1 formed between the vertical wall 33*a* and the flange 35*a* of the intermediate formed component 30 satisfies Equation (5). Thus, in the present exemplary embodiment, twisting in the top plate 2 is reduced as a result of residual tensile stress being reduced in the vertical wall 4*a* and the flange 6*a* of the roof member 1. Note that in the case of the present exemplary embodiment, residual stress at lower portions of the vertical walls 33*a*, 33*b* is reduced in the second pressing process due to forming the steps 36*a*, 36*a*' to the vertical walls 33*a*, 33*b* in the first pressing process.

Advantageous Effect 3

Further, in the case of the present exemplary embodiment, the vertical wall 33*b* and the flange 35*b* of the intermediate formed component 30 are formed in the first pressing process such that the angle therebetween satisfies Equation (6). Thus, in the present exemplary embodiment, twisting in the top plate 2 is reduced as a result of residual compressive stress being reduced in the flange 35*b* of the roof member 1. Note that in the case of the present exemplary embodiment, as illustrated in in FIG. 7A, FIG. 7B, FIG. 7C, and FIG. 7D, the intermediate formed component 30 is pressed in the second pressing process such that the vertical wall 33*b* and the flange 35*b* form the vertical wall 4*b* and the flange 6*b* of the roof member 1. In such cases, compressive stress is reduced due to the differences in line lengths of the vertical wall 33*b* and the flange 35*b* that arise accompanying changing the angle between the vertical wall 33*b* and the flange 35*b*.

Other Advantageous Effect 4

Further, in the case of the present exemplary embodiment, the flange 35*b* of the intermediate formed component 30 is formed in the first pressing process by causing a material end of the blank BL to flow in and flexing the blank BL. Thus, in the first pressing process of the present exemplary embodiment, the amount of spring-back in the first pressing process is reduced due to residual compressive stress being reduced.

The foregoing was an explanation relating to advantageous effects of the present exemplary embodiment.

Second Exemplary Embodiment

Next, explanation follows regarding the second exemplary embodiment. First, explanation follows regarding configuration of a roof member 1A of the present exemplary embodiment illustrated in FIG. 8A, FIG. 8B, FIG. 8C, and FIG. 8D. Explanation then follows regarding configuration of a press apparatus 17A of the present exemplary embodiment illustrated in FIG. 9 and FIG. 10. This will be followed by explanation regarding a manufacturing method of the roof member of the present exemplary embodiment. This will then be followed by explanation regarding advantageous effects of the present exemplary embodiment. Note that the following explanation describes portions of the present exemplary embodiment differing from those of the first exemplary embodiment.

Roof Member Configuration

First, explanation follows regarding configuration of the roof member 1A of the present exemplary embodiment, with reference to the drawings. Note that the roof member 1A is an example of a pressed component and a specific pressed component.

As illustrated in FIG. 8A, FIG. 8B, FIG. 8C, and FIG. 8D, the roof member 1A of the present exemplary embodiment is not provided with the flanges 6*a*, 6*b* of the first exemplary embodiment illustrated in FIG. 1A, FIG. 1B, FIG. 1C, and FIG. 1D. The roof member 1A of the present exemplary embodiment has the same configuration as the roof member 1 of the first exemplary embodiment with the exception of this point.

Press Apparatus Configuration

Explanation follows regarding the press apparatus 17A of the present exemplary embodiment, with reference to the drawings. The press apparatus 17A of the present exemplary embodiment is used to manufacture the roof member 1A of the present exemplary embodiment.

Figure 9:
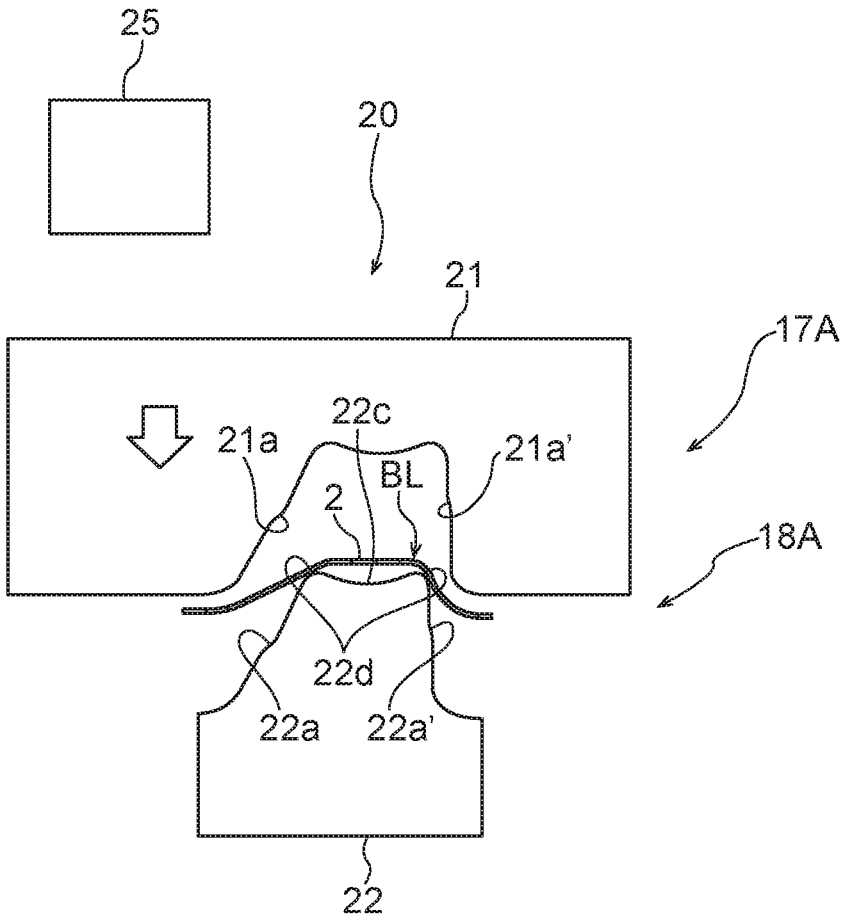
FIG. 9 is a vertical cross-section of a first press device employed in a first pressing process of a manufacturing method of a roof member of the second exemplary embodiment.
Figure 10:
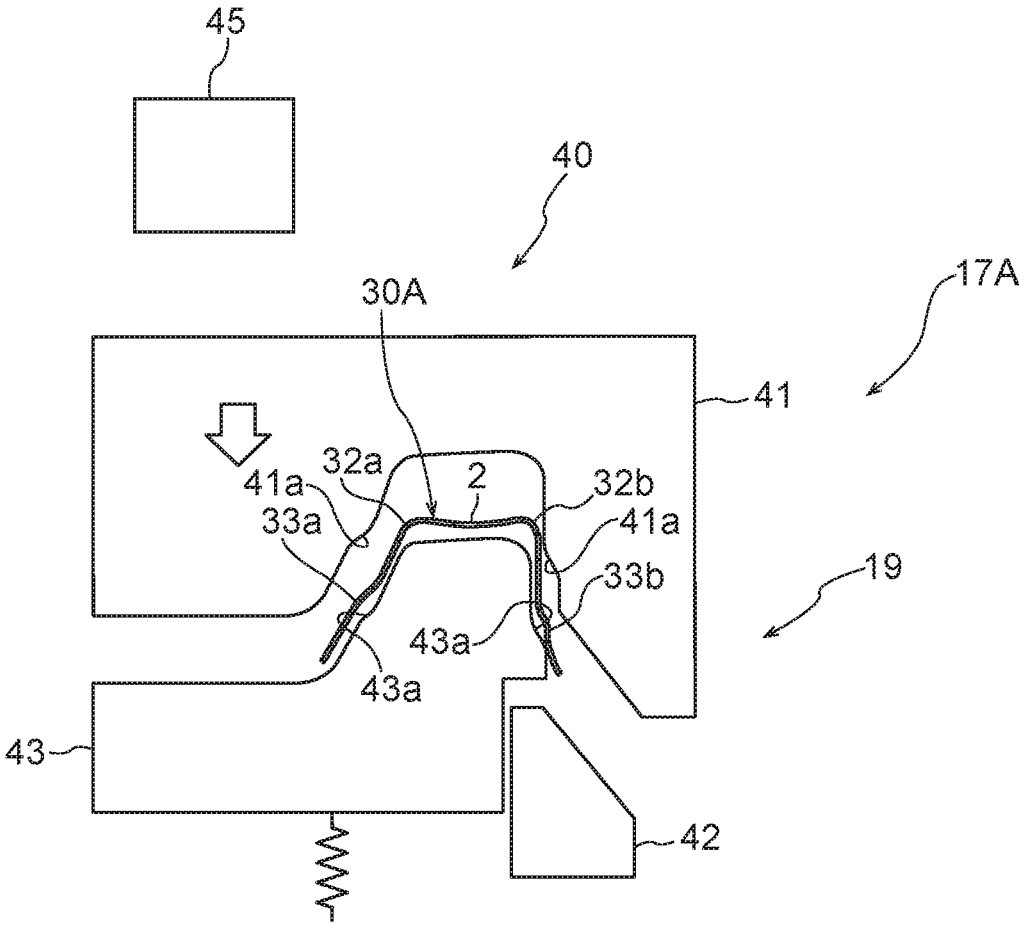
FIG. 10 is a vertical cross-section of a second press device employed in a second pressing process of a manufacturing method of a roof member of the second exemplary embodiment.
Figure 11A:
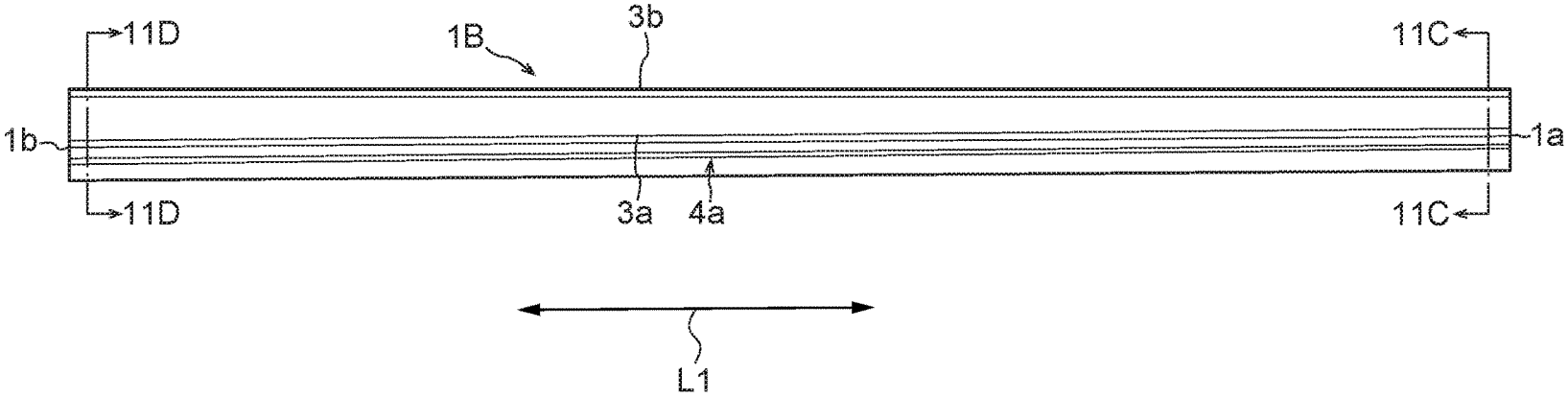
FIG. 11A is a top view illustrating a roof member of a third exemplary embodiment.
Figure 11B:
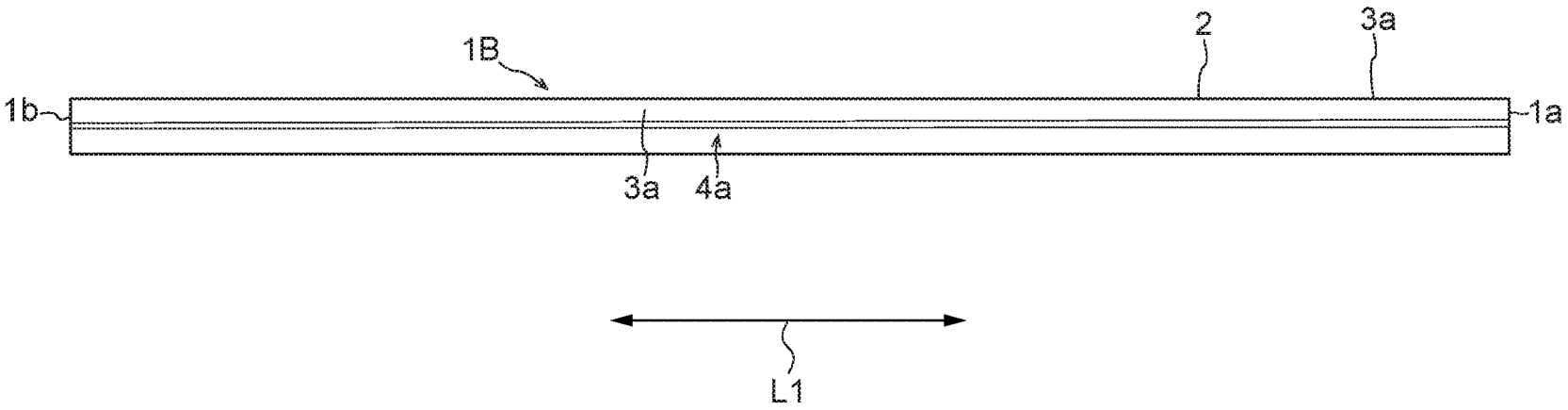
FIG. 11B is a side view illustrating a roof member of the third exemplary embodiment.
Figure 11C:
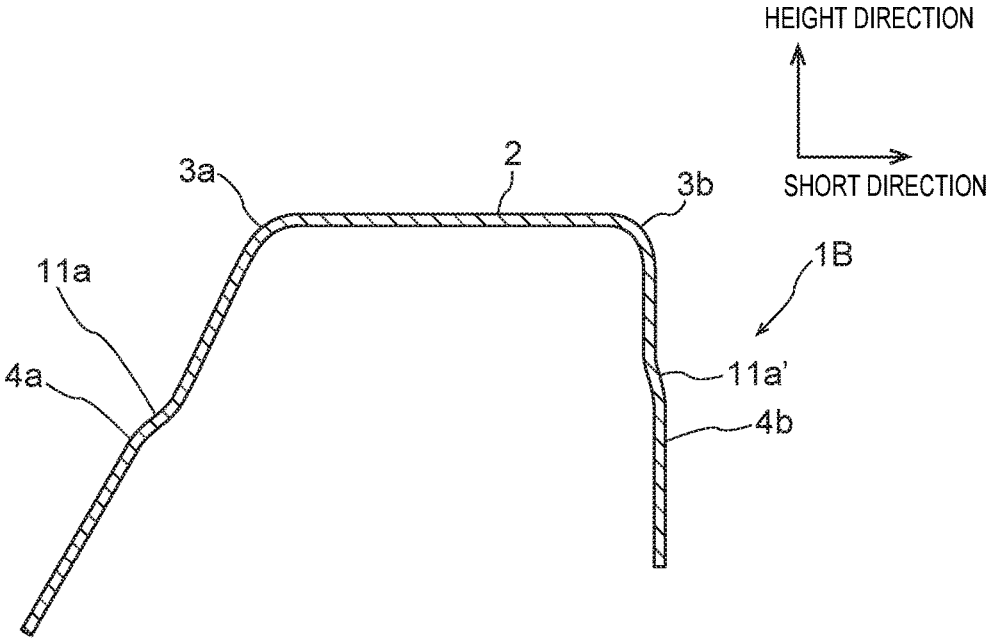
FIG. 11C is a cross-section taken along 11C-11C in FIG. 11A.
Figure 11D:
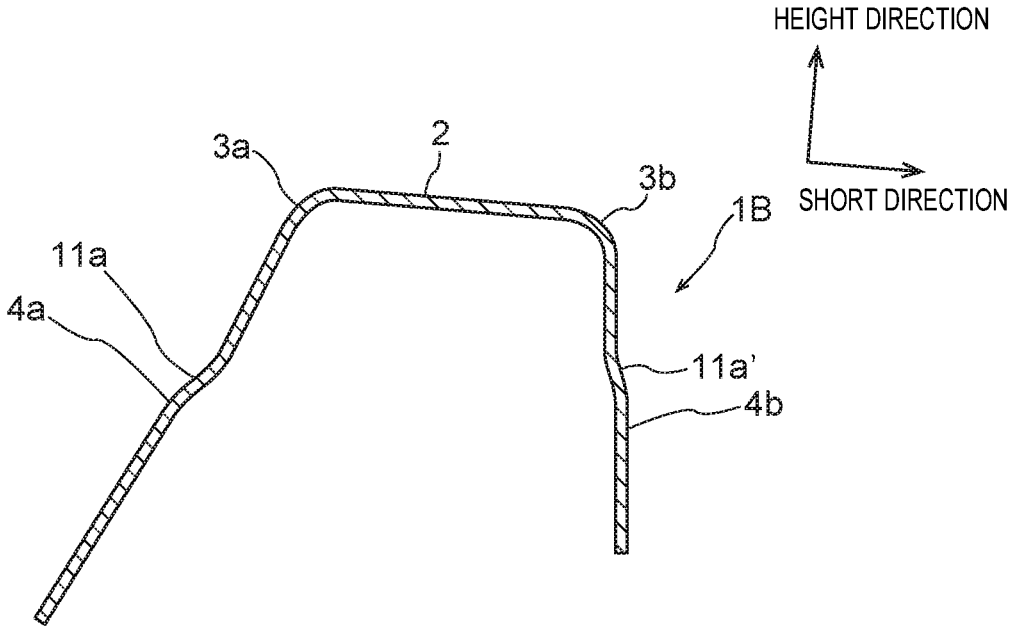
FIG. 11D is a cross-section taken along 11D-11D in FIG. 11A.

A first press device 18A of the present exemplary embodiment, as illustrated in FIG. 9, is not provided with the holders 23, 24 illustrated in FIG. 2B. Note that the first press device 18A is an example of a press device. The press apparatus 17A of the present exemplary embodiment has the same configuration as the press apparatus 17 of the first exemplary embodiment with the exception of this point. Note that an intermediate formed component 30A has the same configuration as the intermediate formed component 30 of the first exemplary embodiment with the exception of the point that the two flanges 35*a*, 35*b* are not provided. Namely, the intermediate formed component 30A of the present exemplary embodiment is configured as a gutter shaped member.

Roof Member Manufacturing Method

Next, explanation follows regarding a manufacturing method of the roof member 1A of the present exemplary embodiment. The manufacturing method of the roof member 1A of the present exemplary embodiment is performed employing the press apparatus 17A. Moreover, in the manufacturing method of the roof member 1A of the present exemplary embodiment, a first pressing process is the same as that of the first exemplary embodiment, with the exception of the point that it is performed using the first press device 18A. Note that in the present exemplary embodiment, in the first pressing process, the blank BL is pressed by bending to form the intermediate formed component 30A illustrated in FIG. 10.

Advantageous Effect

The present exemplary embodiment exhibits the following advantageous effects of the first exemplary embodiment: the advantageous effect of first portion prior contacting, the advantageous effect of being in accordance with Equation (1), and the Advantageous Effects 1, 2, and 3.

The foregoing was an explanation relating to the second exemplary embodiment.

Third Exemplary Embodiment

Explanation follows regarding the third exemplary embodiment. First, explanation is given regarding configuration of a roof member 1B of the present exemplary embodiment illustrated in FIG. 11A, FIG. 11B, FIG. 11C, and FIG. 11D. Next, explanation will be given regarding configuration of a press apparatus, not illustrated in the drawings, of the present exemplary embodiment. Then, explanation will be given regarding a manufacturing method of the roof member of the present exemplary embodiment. This will be followed by explanation regarding advantageous effects of the present exemplary embodiment. Note that in the following explanation, explanation will be given regarding portions of the present exemplary embodiment which differ from those of the first and second exemplary embodiments. In the explanation of the present exemplary embodiment, when the reference signs used for components and the like are similar to the reference signs used for components and the like in the first and second exemplary embodiments, similar reference signs are used in the explanation even if not illustrated in the drawings.

Roof Member Configuration

First, explanation follows regarding configuration of the roof member 1B of the present exemplary embodiment, with reference to the drawings. The roof member 1B is an example of a pressed component and a specific pressed component.

As illustrated in FIG. 11A, FIG. 11B, FIG. 11C, and FIG. 11D, the roof member 1B of the present exemplary embodiment is not provided with the flanges 6*a*, 6*b* illustrated in FIG. 1A, FIG. 1B, FIG. 1C, and FIG. 1D. Further, a length direction central portion of the roof member 1B of the present exemplary embodiment is not curved in the short direction as viewed from the upper side of the top plate 2. Moreover, the roof member 1B of the present exemplary embodiment is not curved in a convex profile bowing toward the top plate 2 side as viewed along the short direction of the top plate 2. Configuration of the roof member 1B of the present exemplary embodiment is similar to that of the roof member 1 of the first exemplary embodiment with the exception of these points.

Press Apparatus Configuration

Explanation follows regarding the press apparatus, not illustrated in the drawings, of the present exemplary embodiment. The press apparatus of the present exemplary embodiment is used to manufacture the roof member 1B of the present exemplary embodiment.

A first press device and a second press device, not illustrated in the drawings, of the present exemplary embodiment are, similarly to the respective first press device 18A and the second press device 19 of the second exemplary embodiment, not provided with the first holders 23, 24 illustrated in FIG. 2B. Further, a groove in the upper mold 21 of the first press device of the present exemplary embodiment is formed in a straight line shape that does not curve as viewed along the direction in which the upper mold 21 and the lower mold 22 face each other, nor in the short direction of the upper mold 21 and the lower mold 22. Further, the lower mold 22 projects out in a straight line shape along its length direction. Configuration of the press apparatus of the present exemplary embodiment is similar to that of the press apparatus 17A of the second exemplary embodiment with the exception of the points above. An intermediate formed component, not illustrated in the drawings, formed by a first pressing process of the present exemplary embodiment is configured similarly to the intermediate formed component 30A of the second exemplary embodiment with the exception of the point that the top plate 2 and the vertical walls 33*a*, 33*b* are not curved along the length direction. Namely, the intermediate formed component of the present exemplary embodiment is configured by a gutter shaped member.

Roof Member Manufacturing Method

Explanation follows regarding the manufacturing method of the roof member 1B of the present exemplary embodiment. The manufacturing method of the roof member 1B of the present exemplary embodiment is the same as that of the second exemplary embodiment with the exception of the point that the press apparatus of the present exemplary embodiment is employed. Note that in the case of the present exemplary embodiment, a blank BL is pressed by bending to form the intermediate formed component in the first pressing process.

Advantageous Effects

The present exemplary embodiment exhibits the following advantageous effects of the first exemplary embodiment: the advantageous effect first portion prior contacting and the advantageous effect of the vertical walls 4*a*, 4*b* being suppressed from closing in due to spring-back, as explained by the advantageous effect of being in accordance with Equation (1), and the Other Advantageous Effects 1 and 2.

The foregoing was an explanation relating to the third exemplary embodiment.

Examples

Explanation follows regarding first, second, and third evaluations in which Examples and Comparative Examples were evaluated, with reference to the drawings. Note that in the following explanation, when the reference signs used for components and the like are similar to the reference signs used for components and the like in the present exemplary embodiment and the second comparative embodiment, the reference signs for these components and the like are being carried over as-is.

First Evaluation

In the first evaluation, twisting and bending were compared between a roof member 1 configuring Example 1, manufactured by the manufacturing method of the roof member of the first exemplary embodiment described above, and a roof member configuring Comparative Example 1, manufactured by the manufacturing method of the roof member of the second comparative embodiment described above. Further, in the first evaluation, the Vickers hardness of the top plate 2 and the convex ridge line portions 3*a*, 3*b* of the roof member 1 of Example 1 and of the roof member of Comparative Example 1 were measured and compared.

Roof Member of Example 1

First, explanation follows regarding the roof member 1 of Example 1. A high tensile sheet steel blank having a plate thickness of 1.2 mm and 1310 MPa grade tensile strength was employed as the blank BL. In the roof member 1 of Example 1 manufactured by the manufacturing method of the roof member of the present exemplary embodiment, the radius of curvature R of the first section 8 was 3000 mm, the radius of curvature R of the second section 9 was 800 mm, and the radius of curvature R of the third section 10 was 4000 mm as viewed from the upper side of the top plate 2. Further, in the roof member 1 of Example 1, the radius of curvature R of the first section 8 was 4000 mm, the radius of curvature R of the second section 9 was 2000 mm, and the radius of curvature R of the third section 10 was 10000 mm as viewed along the short direction of the top plate 2, namely, as viewed from the side of a side-face of the roof member 1. Note that in the first pressing process, the bend outer surface stress $\sigma_s$ of the blank BL was 1234 MPa and the average stress $\sigma_m$ was 100 MPa. Further, the Young's Modulus E of the blank BL was 208 GPa.

Roof Member of Comparative Example 1

The roof member of Comparative Example 1 was manufactured by the manufacturing method of the roof member of the second comparative embodiment employing a high tensile sheet steel blank having a plate thickness of 1.2 mm and 1310 MPa grade tensile strength as the blank BL, similarly to in Example 1. Note that the roof member of Comparative Example 1 was manufactured such that each portion of the respective first, second, and third portions would have the same radius of curvature R as in Example 1.

Comparison Method

Figure 12:
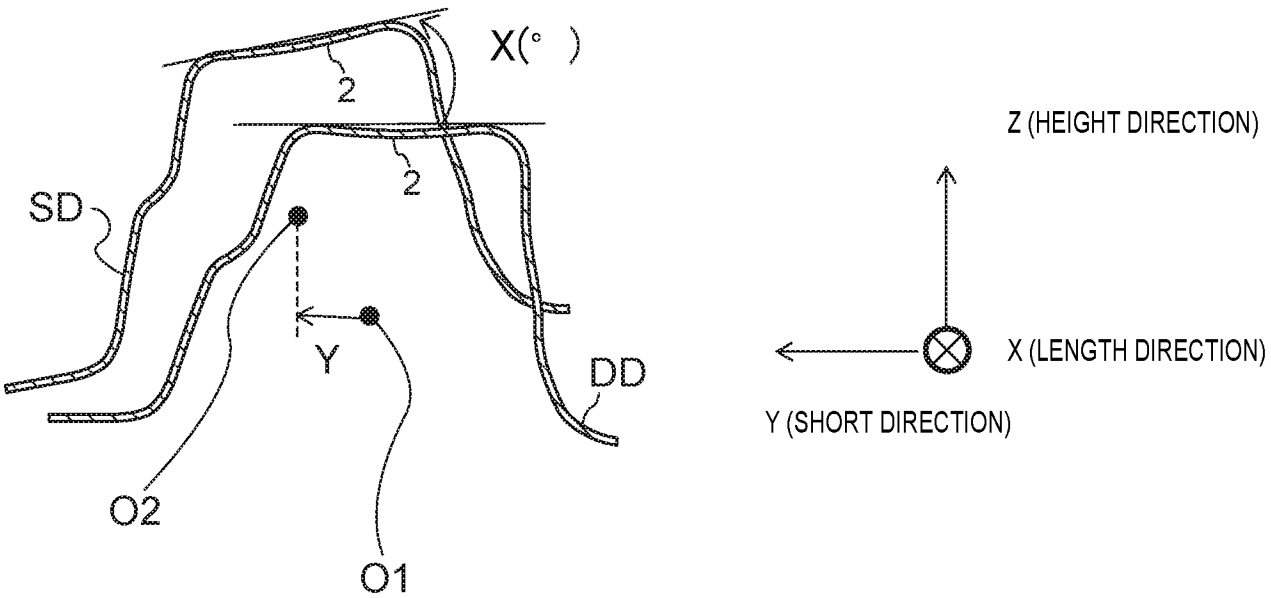
FIG. 12 is a diagram for explaining an evaluation method for twisting and bending.

In the comparison method of the present evaluation, first, a 3-dimension measuring device, not illustrated in the drawings, was used to measure the shapes of the roof member 1 of Example 1 and the roof member of Comparative Example 1. Next, a computer, not illustrated in the drawings, was used to compare measured data SD for the roof member 1 of Example 1 and the roof member of Comparative Example 1 against design data DD. Specifically, as illustrated in FIG. 12, the cross-sections of length direction central portions of the top plate 2 were aligned (best-fit), and an angle of the top plate 2 along the short direction at a front end (rear end) in the design data DD was taken as a reference, and the amount of change in the angle of the top plate 2 at the front end (rear end) of each measured data point with respect to this reference was evaluated as twisting. Further, as illustrated in FIG. 12, the offset amount in the width direction of a center position O2 of a front end face (rear end face) of each measured data point with respect to a center position O1 of the front end face (rear end face) in the design data DD was taken as bending.

Comparison Results and Interpretation

Figure 13:
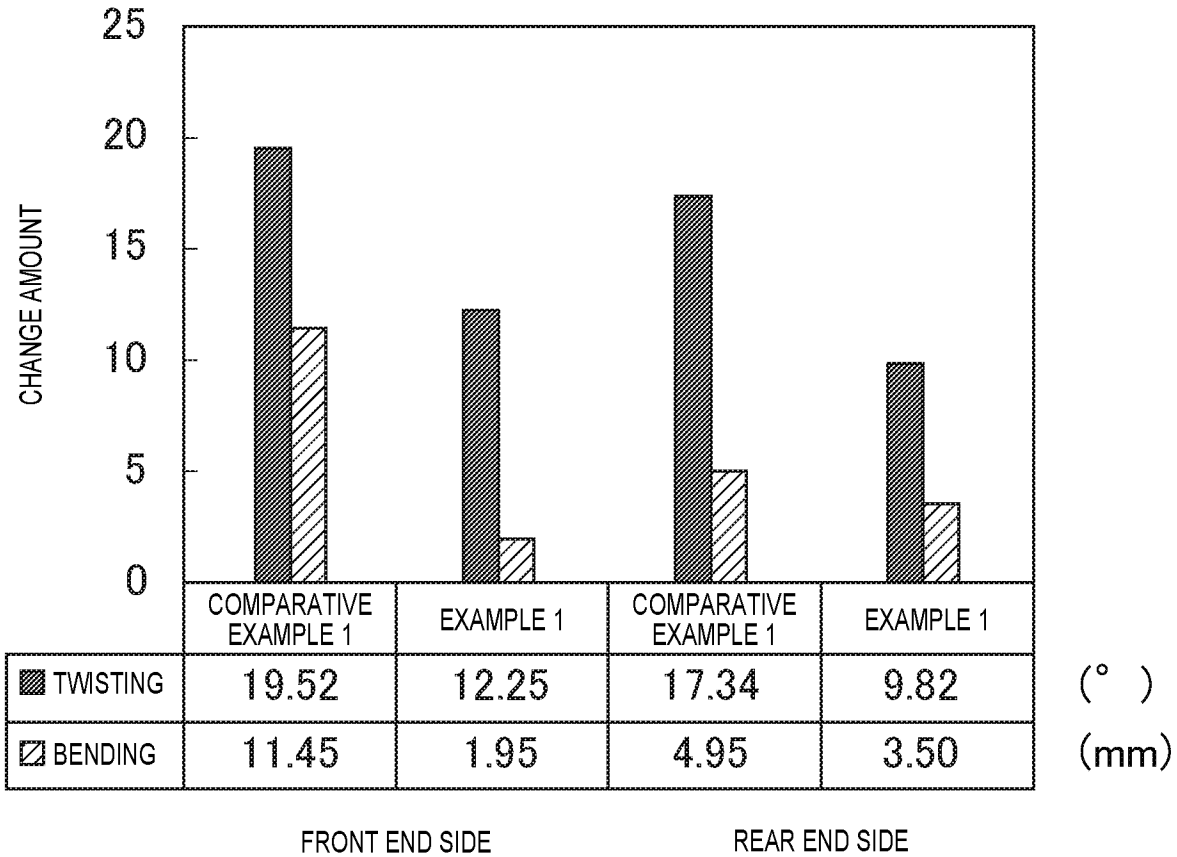
FIG. 13 is a graph illustrating results from measuring twisting and bending in a top plate of a roof member 1 (Example 1) manufactured by a roof member manufacturing method of the first exemplary embodiment, and a roof member (Comparative Example 1) manufactured by a roof member manufacturing method of a second comparative embodiment.

The graph in FIG. 13 illustrates evaluation results for Example 1 and Comparative Example 1. From the graph in FIG. 13, it is apparent that the top plate 2 underwent less twisting in Example 1 than in Comparative Example 1. Further, from the graph in FIG. 13, it is apparent that the vertical walls 33*a*, 33*b* underwent less bending in Example 1 than in Comparative Example 1. According to the evaluation results above, Example 1 may be considered as exhibiting the advantageous effects explained in the first exemplary embodiment.

Vickers Hardness

Further, the graph in FIG. 14 illustrates the results of measuring Vickers hardness of the top plate, measured in a range spanning from one end to another end in the short direction of the top plate 2 of Example 1, and the Vickers hardness of the top plate measured in a range spanning from one end to another end in the short direction of the top plate of Comparative Example 1. The top plate 2 of Example 1 has a Vickers hardness value that is smaller than that of the top plate of Comparative Example 1 throughout, namely, over the entirety of a region spanning from the one end to the other end in the short direction of the top plate 2. Further, in the case of the top plate of Comparative Example 1, the value of the Vickers hardness is equal throughout, whereas in the case of the top plate 2 of Example 1, the value of the Vickers hardness differs as follows. Namely, in the case of the top plate 2 of Example 1, the top plate 2 includes the central portion where the Vickers hardness value is a minimum value at the short direction center of the top plate 2, namely, the minimum portion. The top plate 2 also includes the maximum portions where the respective Vickers hardness value is a maximum value in each range out of a first range that is the range between the central portion and the one short direction end of the top plate 2 and a second range that is the range between the center portion and the other short direction end of the top plate 2. It is thought that the reason the Vickers hardness characteristics of the top plate 2 of Example 1 and the top plate of Comparative Example 1 differ from each other in this manner is due to the top plate 2 of Example 1 having the advantageous effect of being in accordance with Equation (1), namely, the advantageous effect as a result of the Bauschinger effect. Further, as in the evaluation results described above, the roof member 1 of Example 1 does not twist, namely, has a smaller spring-back amount than the roof member of Comparative Example 1. From another perspective, the roof member 1 of Example 1 may be said to be of a higher precision than the roof member that includes a top plate having a Vickers hardness value that is equal throughout. Note that as explained above, the reason for defining each maximum portion as where the respective Vickers hardness value is a maximum value within each range out of the first range and the second range, is to indicate that portions where the Vickers hardness is a maximum value within each range are not at the two short direction ends of the top plate 2. Further, the Vickers hardness value of the central portion, namely, the minimum portion of the top plate 2 of Example 1 is at least 2.3% smaller than the Vickers hardness values of the respective maximum portions.

Second Evaluation

Evaluation Method, etc.

In the second evaluation, twisting at the front end and the rear end of the top plate 2 was evaluated for roof members 1 of Examples 2 to 8 produced by simulation based on the roof member manufacturing method of the first exemplary embodiment described above, and for roof members of Comparative Examples 2 to 6 produced by simulation based on the roof member manufacturing method of the second comparative embodiment described above.

The table in FIG. 15 lists the simulation parameters and evaluation results for Examples 2 to 8 and Comparative Examples 2 to 6. In the table in FIG. 15, "plate thickness" refers to the thickness of the blank BL that is employed in the simulation. "Strength" refers to the tensile strength of the blank BL that is used in the simulation. "Shape of top plate portion" refers to there being a curved cross-section profile on the first mold 20 used in the simulation. The curved cross-section profile in the shape of the top plate portion of the first mold 20 used in the simulation corresponds to the radius of curvature R in Equation (1) or Equation (2). "Evaluation of cross-section 1 twisting" refers to twisting at a portion 10 mm toward the center from the front end in the length direction, and "evaluation of cross-section 2 twisting" refers to twisting at a portion 10 mm toward the center from the rear end in the length direction. Note that each combination of plate thickness, strength, and top plate portion profile in Examples 2 to 8 satisfies the conditions in both Equation (1) and Equation (2). Further, where each top plate portion profile is listed as "none" in Comparative Examples 2 to 6, this indicates the top plate 2 remaining flat when pressed in the first pressing process.

Evaluation Results and Interpretation

From the table in FIG. 15, it is apparent that the top plate 2 underwent less twisting in the roof members of Examples 2 to 8 than in the roof members of Comparative Examples 2 to 6. For example, the respective simulation parameter for plate thickness and strength were the same in Example 2 and Comparative Example 2. When comparing the simulation results for evaluation of cross-section 1 twisting, it is apparent that the top plate 2 underwent less twisting in the roof member of Example 2 than in the roof member of Comparative Example 2. Further, when comparing the simulation results of evaluation of cross-section 2 twisting, it is apparent that the top plate 2 underwent less twisting in the roof member of Example 2 than in the roof member of Comparative Example 2. Note that the evaluation of cross-section 2 twisting in Example 2 was −7.52°, with the "−" sign indicating twisting that is clockwise. Thus, it may be said that when comparing the absolute values of the angles, the top plate 2 underwent less twisting in the roof member of Example 2 than in the roof member of Comparative Example 2. Further, when comparing combinations having the same simulation parameters for plate thickness and strength (for example, Example 3 and Comparative Example 2, Example 4 and Comparative Example 4, etc.), it is apparent that the top plate 2 underwent less twisting in the respective Examples than in the respective Comparative Examples. According to the evaluation results above, Examples 2 to 8 satisfy the conditions in Equation (1) and Equation (2), and thus may be considered as exhibiting the advantageous effect of being in accordance with Equation (1) irrespective of the differences in tensile strength between the blanks BL.

Third Evaluation

Evaluation Method, etc.

In the third evaluation, twisting at the front end and the rear end was compared between roof members 1A of Examples 9 to 14 produced by simulation based on the roof member manufacturing method of the second exemplary embodiment described above, and for roof members of Comparative Examples 7 to 11 produced by simulation based on the roof member manufacturing method explained below.

Roof Members of Comparative Examples 7 to 11

The roof members of Comparative Examples 7 to 11 were not provided with the flanges 6*a*, 6*b* illustrated in FIG. 1A, FIG. 1B, FIG. 1C, and FIG. 1D, similarly to in Examples 9 to 15, namely similarly to the roof member 1A of the second exemplary embodiment. Thus, the roof members of Comparative Examples 7 to 11 were produced by simulation under the assumption of pressing by bending.

The table in FIG. 16 lists the simulation parameters and evaluation results for Examples 9 to 14 and Comparative Examples 7 to 11. "Plate thickness", "strength", "top plate portion profile" "evaluation of cross-section 1 twisting" and "evaluation of cross-section 2 twisting" in the table in FIG. 16 refer to the same things as in the case of the table in FIG. 15. Note that the combinations of plate thickness, strength, and top plate portion profile in each of Examples 9 to 14 satisfy the conditions in both Equation (1) and Equation (2).

Evaluation Results and Interpretation

From the table in FIG. 16, it is apparent that the top plate 2 underwent less twisting in the roof members of Examples 9 to 14 than in the roof members of Comparative Examples 7 to 11. For example, Example 9 and Comparative Example 7 had the same simulation parameters for both plate thickness and strength. When comparing the simulation results for evaluation of cross-section 1 twisting, it is apparent that the top plate 2 underwent less twisting in the roof member of Example 9 than in the roof member of Comparative Example 7. Further, when comparing the simulation results for evaluation of cross-section 2 twisting, it is apparent that the top plate 2 underwent less twisting in the roof member of Example 9 than in the roof member of Comparative Example 7. Moreover, when comparing combinations having the same simulation parameters for plate thickness and strength, for example, Example 12 and Comparative Example 10, Example 13 and Comparative Example 11, and so on, it is apparent that the top plate 2 underwent less twisting in each Example than in the respective Comparative Example. According to the evaluation results described above, in the case of Examples 9 to 14, each Example satisfies the condition in Equation (1), and thus may be considered as exhibiting the advantageous effect of being in accordance with Equation (1) irrespective of the differences in tensile strength between the blanks BL.

Summary of Examples

As explained above, explanation has been given regarding advantageous effects of the first and the second exemplary embodiments based on the first to the third evaluations. However, it is apparent from the second and third evaluations that the roof members of Examples 2 to 14 underwent less twisting than the roof members of Comparative Examples 2 to 11, irrespective of the presence or absence of the flanges 6*a*, 6*b* of the roof member 1. Note that Examples have not been described for the third exemplary embodiment; however, it is anticipated that there would be less twisting due to the advantageous effect of being in accordance with Equation (1) in the case of the third exemplary embodiment as well.

As explained above, explanation has been given regarding specific exemplary embodiments of the present disclosure and Examples thereof, namely, the first, second, and third exemplary embodiments and Examples 2 to 14. However, configurations other than those of the first, second, and third exemplary embodiments and Examples 2 to 14 described above are also included within the technical scope of the present disclosure. For example, modified examples of the following configurations are also included within the technical scope of the present disclosure.

In each of the exemplary embodiments, explanation has been given using a roof member as an example of a pressed component. However, the pressed component may be an automotive component other than a roof member as long as it is manufactured by pressing that satisfies the conditions in Equation (1) or Equation (2). Moreover, the pressed component may also be a component other than an automotive component as long as it is manufactured by pressing that satisfies the conditions in Equation (1) or Equation (2).

In each exemplary embodiment, explanation has been given in which the steps 11*a*, 11*a*' are respectively formed to the vertical walls 4*a*, 4*b*. However, the pressed component may be configured without forming the steps 11*a*, 11*a*' to the vertical walls 4*a*, 4*b*, as long as the pressed component is manufactured by pressing that satisfies the conditions in Equation (1) or Equation (2).

Explanation has been given in which the manufacturing method of the roof member of each exemplary embodiment includes the first pressing process and the second pressing process. However, the pressed component need not be subjected to the second pressing process as long as the pressed component is manufactured by pressing that satisfies the conditions in Equation (1) or Equation (2).

Explanation has been given in which, in the manufacturing method of the roof member of each exemplary embodiment, the intermediate formed component 30 formed by the first pressing process undergoes the second pressing process so as to manufacture the pressed component. However, since the pressed component is manufactured by pressing that satisfies the conditions in Equation (1) or Equation (2), the intermediate formed components 30, 30A described in each exemplary embodiment may be understood to be examples of a pressed component. In such cases, the first pressing process and the second pressing process may be implemented by different parties.

Examples of the plate thickness, the tensile strength, the top plate portion profile, and the like of the blank BL were given in the explanation of each of the exemplary embodiments and in the explanation of the first to third evaluations of the Examples. However, combinations other than the combinations given as examples in each of the exemplary embodiments and the Examples may be implemented as long as the parameters of these combinations satisfy the conditions in Equation (1) or Equation (2). For example, even if the tensile strength of the blank BL were more than 1470 (MPa) or were less than 590 (MPa), this would be acceptable as long as the conditions in Equation (1) and Equation (2) were satisfied based on the relationships between the other parameters ($\sigma_s$, $\sigma_m$, E, and so on). Further, for example, even if the plate thickness of the blank BL were less than 1.0 mm or were the blank BL to have a thickness greater than 1.2 mm, this would be acceptable as long as the conditions in Equation (1) or Equation (2) were satisfied based on the relationships between the other parameters described above.

Explanation has been given in which the roof members 1, 1A, and 1B of the respective exemplary embodiments are manufactured by bending a blank BL from the lower mold 22 side toward the upper mold 21 side in a state in which the shoulders 22*d* of the lower mold 22 contact the first portion of the blank BL, before sandwiching the blank BL between the upper mold 21 and the lower mold 22 and indenting the blank BL from the upper mold 21 side toward the lower mold 22 side. Namely, explanation has been given in which the roof members 1, 1A, and 1B of the respective exemplary embodiments are manufactured by forming the first portion of the blank BL prior to forming the second portion. However, the pressed component may have a different shape to that of the roof members 1, 1A, and 1B of the present exemplary embodiment as long as the pressed component is manufactured such that the first portion of the blank BL is formed prior to the second portion of the blank BL. For example, the pressed component may be configured with the shapes of the respective modified examples described above.

Supplement

The following additional disclosure is a generalization from the present specification. Namely, the additional disclosure is "A manufacturing method for a pressed component, the manufacturing method comprising:

a first pressing performed employing a punch, a die, and a holder to manufacture a blank into an intermediate formed component having a substantially hat-shaped lateral cross-section profile configured by a top plate extending in a length direction, two ridge lines respectively connected at both sides of the top plate, two vertical walls connected to the two respective ridge lines, two concave ridge line portions connected to the two respective vertical walls, and two flanges connected to the two respective concave ridge line portions;

a second pressing performed employing a punch, a die, and a holder to manufacture the intermediate formed component into a pressed component that is a cold pressed component configured from sheet steel having a tensile strength of from 440 to 1600 MPa, that has a total length of 500 mm or more, and that has a substantially hat-shaped lateral cross-section profile configured by a substantially flat top plate that extends in the length direction and that has a width of 40 mm or less, two ridge lines respectively connected at both sides of the top plate, two vertical walls that are connected to the two respective ridge lines, two concave ridge line portions connected to the two respective vertical walls, and two flanges connected to the two respective concave ridge line portions, wherein in the first pressing, the top plate of the intermediate formed component is formed into a curved shape such that in a cross-section perpendicular to a length direction of the top plate, the top plate is indented toward the inside of the substantially hat-shaped cross-section with a radius of curvature R (mm) as defined in the equation below, and in the second pressing, the cross-section profile of the top plate of intermediate formed component is formed into the cross-section profile of the pressed component.

$$\frac{t \cdot E \cdot 1000}{2(\sigma_s - \sigma_m)} \times 0.5 \leq R \leq \frac{t \cdot E \cdot 1000}{2(\sigma_s - \sigma_m)} \times 4$$

wherein the parameters in the equation are as follows:

t is a plate thickness (mm) of the blank;

$\sigma_s$ is a short direction bend outer surface stress (MPa) of a portion of the blank to form the top plate;

$\sigma_m$ is an average stress in cross section of short direction (MPa) of the portion of the blank to form the top plate; and E is a Young's Modulus (GPa) of sheet steel configuring the blank.

The disclosures of Japanese Patent Application No. 2015-087502 and No. 2015-087503, filed on Apr. 22, 2015, are incorporated in their entirety by reference herein. All cited documents, patent applications, and technical standards mentioned in the present specification are incorporated by reference in the present specification to the same extent as if the individual cited document, patent application, or technical standard was specifically and individually indicated to be incorporated by reference.

The invention claimed is:

1. A manufacturing method for a pressed component including an elongated top plate, ridge line portions at both short direction ends of the top plate, and vertical walls that face each other in a state extending from the ridge line portions, the manufacturing method comprising:

punching a blank, via a die and a punch, the punching including curving the blank into a convex profile bowing from a punch side toward a die side in a state in which the punch is caused to contact a first portion of the blank where the two end ridge line portions are to be formed, and atoll sandwiching a second portion of the blank where the top plate is to be formed between the die and the punch, and indent the second portion from the die side toward the punch side such that the second portion has a radius of curvature R (mm) that satisfies Equation (1)

$$\frac{t \cdot E \cdot 1000}{2|\sigma_s - \sigma_m|} \times 0.5 \leq R \leq \frac{t \cdot E \cdot 1000}{2|\sigma_s - \sigma_m|} \times 4 \quad (1)$$

wherein each parameter in Equation (1) is as follows:

t is a plate thickness (mm) of the blank;

$\sigma_s$ is a short direction bend outer surface stress (MPa) of the second portion of the blank to form the top plate;

$\sigma_m$ is an average stress in cross section of short direction (MPa) of the portion of the blank to form the top plate; and E is a Young's Modulus (GPa) of sheet steel configuring the blank.

2. The pressed component manufacturing method of claim 1, wherein:

an apex face of the punch is curved as viewed along a direction in which the punch and the die face each other, and a groove that is curved so as to follow the apex face of the punch is formed in the die; and a pressed component is manufactured in which the top plate is curved as viewed along a plate thickness direction of the top plate.

3. The pressed component manufacturing method of claim 1, wherein:

an apex face of the punch is curved in a convex profile bowing toward the die side as viewed along an orthogonal direction orthogonal to both an a direction in which the punch and the die face each other and the length direction of the punch, and a groove that is curved so as to follow the apex face of the punch is formed in the die; and a pressed component is manufactured in which the top plate is curved as viewed along a short direction of the top plate.

4. A manufacturing method for a pressed component including an elongated top plate, ridge line portions at both short direction ends of the top plate, and vertical walls that face each other in a state extending from the ridge line portions, the manufacturing method comprising:

punching a blank, via a die and a punch, the punching including curving the blank into a convex profile bowing from a punch side toward a die side in a state in which the punch is caused to contact a first portion of the blank where the two end ridge line portions are to be formed, and sandwiching a second portion of the blank where the top plate is to be formed between the die and the punch, and indent the second portion from the die side toward the punch side such that the second portion has a radius of curvature R (mm) that satisfies Equation (2)

$$\frac{t \cdot E \cdot 1000}{2 \cdot \sigma_{TS}} \leq R \leq \frac{t \cdot E \cdot 1000}{\sigma_{YP}} \quad (2)$$

wherein each parameter in Equation (2) is as follows:

t is a plate thickness (mm) of the blank;

$\sigma_{TS}$ is a tensile strength (MPa) of the blank;

$\sigma_{YP}$ is a yield stress (MPa) of the blank; and

E is a Young's Modulus (GPa) of sheet steel configuring the blank.

* * * * *